US007360612B2

(12) United States Patent
Chen et al.

(10) Patent No.: US 7,360,612 B2
(45) Date of Patent: Apr. 22, 2008

(54) ROLLER CONE DRILL BITS WITH OPTIMIZED BEARING STRUCTURES

(75) Inventors: Shilin Chen, The Woodlands, TX (US); Ping C. Sui, The Woodlands, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 315 days.

(21) Appl. No.: 11/202,878

(22) Filed: Aug. 12, 2005

(65) Prior Publication Data

US 2006/0032674 A1 Feb. 16, 2006

Related U.S. Application Data

(60) Provisional application No. 60/601,952, filed on Aug. 16, 2004.

(51) Int. Cl.
*E21B 10/00* (2006.01)

(52) U.S. Cl. ..... 175/372; 175/40

(58) Field of Classification Search ..... None
See application file for complete search history.

(56) References Cited

U.S. PATENT DOCUMENTS

| | | | | |
|---|---|---|---|---|
| 1,209,299 | A | 12/1916 | Hughes | |
| 1,263,802 | A | 4/1918 | Reed | |
| 1,394,769 | A | 10/1921 | Sorensen | |
| 1,847,981 | A | 3/1932 | Reed | |
| 2,038,386 | A | 4/1936 | Scott et al. | 255/71 |
| 2,117,679 | A | 5/1938 | Reed | 255/71 |
| 2,122,759 | A | 7/1938 | Scott | 255/71 |
| 2,132,498 | A | 10/1938 | Smith | 255/71 |
| 2,165,584 | A | 7/1939 | Smith et al. | 255/71 |
| 2,230,569 | A | 2/1941 | Howard et al. | 255/71 |
| 2,496,421 | A | 2/1950 | Stokes | 255/71 |
| 2,728,559 | A | 12/1955 | Boice et al. | 255/334 |
| 2,851,253 | A | 9/1958 | Boice | 255/347 |
| 4,056,153 | A | 11/1977 | Miglierini | 175/376 |
| 4,187,922 | A | 2/1980 | Phelps | 175/374 |
| 4,285,409 | A | 8/1981 | Allen | 175/336 |
| 4,334,586 | A | 6/1982 | Schumacher | 175/374 |
| 4,343,371 | A | 8/1982 | Baker, III et al. | 175/329 |
| 4,343,372 | A | 8/1982 | Kinzer | 175/374 |
| 4,393,948 | A | 7/1983 | Fernandez | 175/374 |

(Continued)

FOREIGN PATENT DOCUMENTS

| | | |
|---|---|---|
| CN | 2082755 U | 8/1991 |

(Continued)

OTHER PUBLICATIONS

MA Dekun, *The Operational Mechanics of the Rock Bit*, Petroleum Industry Press, Beijing, China, 1996.

(Continued)

*Primary Examiner*—Frank Tsay
(74) *Attorney, Agent, or Firm*—Baker Botts L.L.P.

(57) ABSTRACT

A roller cone drill bit may include optimally designed bearing structures and cutting structures. The roller cone drill bit may include three cone assemblies rotatably mounted on respective spindles via respective bearing structures. Each cone assembly may have a respective cutting structure with a minimal moment center located along each respective axis of rotation. Each respective bearing structure has a center point located proximate each respective minimal moment center.

16 Claims, 20 Drawing Sheets

U.S. PATENT DOCUMENTS

| | | | | |
|---|---|---|---|---|
| 4,408,671 | A | 10/1983 | Munson | 175/377 |
| 4,427,081 | A | 1/1984 | Crawford | 175/376 |
| 4,455,040 | A | 6/1984 | Shinn | 285/142 |
| 4,611,673 | A | 9/1986 | Childers et al. | 175/340 |
| 4,627,276 | A | 12/1986 | Burgess et al. | 73/151 |
| 4,657,093 | A | 4/1987 | Schumacher | 175/353 |
| 4,738,322 | A | 4/1988 | Hall et al. | 175/329 |
| 4,776,413 | A | 10/1988 | Forsberg | 175/410 |
| 4,804,051 | A | 2/1989 | Ho | 175/26 |
| 4,815,342 | A | 3/1989 | Brett et al. | 76/108 |
| 4,848,476 | A | 7/1989 | Deane et al. | 175/340 |
| 4,889,017 | A | 12/1989 | Fuller et al. | 76/108 A |
| 5,010,789 | A | 4/1991 | Brett et al. | 76/108.2 |
| 5,027,913 | A | 7/1991 | Nquyen | 175/336 |
| 5,042,596 | A | 8/1991 | Brett et al. | 175/57 |
| 5,131,478 | A | 7/1992 | Brett et al. | 175/57 |
| 5,131,480 | A | 7/1992 | Lockstedt et al. | 175/374 |
| 5,137,097 | A | 8/1992 | Fernandez | 175/228 |
| 5,197,555 | A | 3/1993 | Estes | 175/374 |
| 5,216,917 | A | 6/1993 | Detournay | 73/151 |
| 5,224,560 | A | 7/1993 | Fernandez | 175/374 |
| RE34,435 | E | 11/1993 | Warren et al. | 175/398 |
| 5,285,409 | A | 2/1994 | Hwangbo et al. | 365/189.12 |
| 5,291,807 | A | 3/1994 | Vanderford | 76/108.2 |
| 5,305,836 | A | 4/1994 | Holbrook et al. | 175/39 |
| 5,311,958 | A | 5/1994 | Isbell et al. | 175/341 |
| 5,318,136 | A | 6/1994 | Rowsell et al. | 175/24 |
| 5,341,890 | A | 8/1994 | Cowthorne et al. | 175/374 |
| 5,351,770 | A | 10/1994 | Cawthorne et al. | 175/374 |
| 5,370,234 | A | 12/1994 | Sommer, Jr. et al. | 209/44.1 |
| 5,372,210 | A | 12/1994 | Harrell | 175/431 |
| 5,394,952 | A | 3/1995 | Johns et al. | 175/332 |
| 5,415,030 | A | 5/1995 | Jogi et al. | 73/151 |
| 5,416,697 | A | 5/1995 | Goodman | 364/422 |
| 5,421,423 | A | 6/1995 | Huffstutler | 175/374 |
| 5,456,141 | A | 10/1995 | Ho | 76/108.2 |
| 5,513,711 | A | 5/1996 | Williams | 175/57 |
| 5,579,856 | A | 12/1996 | Bird | 175/375 |
| 5,595,252 | A | 1/1997 | O'Hanlon | 175/57 |
| 5,595,255 | A | 1/1997 | Huffstutler | 175/331 |
| 5,605,198 | A | 2/1997 | Tibbitts et al. | 175/432 |
| 5,636,700 | A | 6/1997 | Shamburger, Jr. | 175/331 |
| 5,697,994 | A | 12/1997 | Packer et al. | 51/309 |
| 5,704,436 | A | 1/1998 | Smith et al. | 175/27 |
| 5,715,899 | A | 2/1998 | Liang et al. | 175/374 |
| 5,730,234 | A | 3/1998 | Putot | 175/50 |
| 5,767,399 | A | 6/1998 | Smith et al. | 73/152.11 |
| 5,794,720 | A | 8/1998 | Smith et al. | 175/40 |
| 5,812,068 | A | 9/1998 | Wisler et al. | 340/855.5 |
| 5,813,480 | A | 9/1998 | Zaleski, Jr. et al. | 175/40 |
| 5,813,485 | A | 9/1998 | Portwood | 175/430 |
| 5,839,526 | A | 11/1998 | Cisneros et al. | 175/431 |
| 5,853,245 | A | 12/1998 | Price | 384/96 |
| 5,967,245 | A | 10/1999 | Garcia et al. | 175/374 |
| 6,002,985 | A | 12/1999 | Stephenson | 702/13 |
| 6,003,623 | A | 12/1999 | Meiss | 175/430 |
| 6,012,015 | A | 1/2000 | Tubel | 702/6 |
| 6,021,377 | A | 2/2000 | Dubinsky et al. | 702/9 |
| 6,029,759 | A | 2/2000 | Sue et al. | 175/374 |
| 6,044,325 | A | 3/2000 | Chakravarthy et al. | 702/7 |
| 6,057,784 | A | 5/2000 | Schaaf et al. | 340/854.4 |
| 6,095,262 | A | 8/2000 | Chen | 175/57 |
| 6,095,264 | A | 8/2000 | Dillard | 175/331 |
| 6,109,368 | A | 8/2000 | Goldman et al. | 175/39 |
| 6,119,797 | A | 9/2000 | Hong et al. | 175/336 |
| 6,142,247 | A | 11/2000 | Pessier | 175/340 |
| 6,176,329 | B1 | 1/2001 | Portwood et al. | 175/341 |
| 6,213,225 | B1 | 4/2001 | Chen | 175/57 |
| 6,241,034 | B1 | 6/2001 | Steinke et al. | 175/331 |
| 6,260,635 | B1 | 7/2001 | Crawford | 175/371 |
| 6,269,892 | B1 | 8/2001 | Boulton et al. | 175/61 |
| 6,308,790 | B1 | 10/2001 | Mensa-Wilmot et al. | 175/73 |
| 6,348,110 | B1 | 2/2002 | Evans | 148/528 |
| 6,349,595 | B1 | 2/2002 | Civolani et al. | 73/152.02 |
| 6,374,930 | B1 | 4/2002 | Singh et al. | 175/374 |
| 6,401,839 | B1 | 6/2002 | Chen | 175/57 |
| 6,412,577 | B1 | 7/2002 | Chen | 175/57 |
| 6,499,547 | B2 | 12/2002 | Scott et al. | 175/374 |
| 6,516,293 | B1 | 2/2003 | Huang et al. | 703/10 |
| 6,527,068 | B1 | 3/2003 | Singh et al. | 175/431 |
| 6,533,051 | B1 | 3/2003 | Singh et al. | 175/371 |
| 6,581,699 | B1 | 6/2003 | Chen et al. | 175/61 |
| 6,607,047 | B1 | 8/2003 | Swadi et al. | 175/374 |
| 6,619,411 | B2 | 9/2003 | Singh et al. | 175/57 |
| 6,729,420 | B2 | 5/2004 | Mensa-Wilmot | 175/385 |
| 6,848,518 | B2 | 2/2005 | Chen et al. | 175/61 |
| 6,856,949 | B2 | 2/2005 | Singh et al. | 703/7 |
| 6,879,947 | B1 | 4/2005 | Glass | 703/10 |
| 7,079,996 | B2 | 7/2006 | Stewart et al. | 703/8 |
| 7,147,066 | B2 | 12/2006 | Chen et al. | 175/61 |
| 7,260,514 | B2 * | 8/2007 | Huang | 703/2 |
| 2001/0042642 | A1 | 11/2001 | King | 175/40 |
| 2004/0045742 | A1 | 3/2004 | Chen | 175/374 |
| 2004/0104053 | A1 | 6/2004 | Chen | 175/341 |
| 2004/0118609 | A1 | 6/2004 | Dennis | 175/57 |
| 2004/0167762 | A1 | 8/2004 | Chen | 703/10 |
| 2004/0254664 | A1 | 12/2004 | Centala et al. | 700/97 |
| 2005/0015230 | A1 | 1/2005 | Centala et al. | 703/10 |
| 2006/0032674 | A1 | 2/2006 | Chen et al. | 175/372 |

FOREIGN PATENT DOCUMENTS

| | | | |
|---|---|---|---|
| EP | 0384734 | A1 | 8/1990 |
| EP | 0511547 | A2 | 4/1992 |
| EP | 0511547 | A3 | 4/1992 |
| EP | 0511547 | B1 | 4/1992 |
| EP | 1006256 | | 6/2000 |
| GB | 2186715 | | 8/1987 |
| GB | 2241266 | A | 8/1991 |
| GB | 2305195 | A | 4/1997 |
| GB | 2327962 | | 2/1999 |
| GB | 2363409 | A | 6/2001 |
| GB | 2365899 | A | 2/2002 |
| GB | 2367578 | A | 4/2002 |
| GB | 2367579 | A | 4/2002 |
| GB | 2367626 | | 4/2002 |
| GB | 2384567 | | 7/2003 |
| GB | 2388857 | | 11/2003 |
| GB | 2400696 | | 10/2004 |
| RU | 1768745 | A1 | 10/1992 |
| SU | 1654515 | A1 | 3/1988 |
| SU | 1691497 | A1 | 5/1988 |
| SU | 1441051 | A2 | 11/1988 |

OTHER PUBLICATIONS

D. Ma, D. Zhou & R. Deng, *The Computer Stimulation of the Interaction Between Roller Bit and Rock*, (1995).

Shilin Chen, *Linear and Nonlinear Dynamics of Drillstrings*, 1994-1995.

D. Ma, & J.J. Azar, *Dynamics of Roller Cone Bits*, Dec. 1985.

D.K.Ma & S.L. Yang, *Kinamatics of the Cone Bit*, Jun. 1985.

Dma & J.J. Azar, *A New Way to Characterize the Gouging-Scraping Action of Roller Cone Bits*, 1989.

Russian bit catalog listing items "III 190,5 T-LIB-1" and "III 109,5 TKZ-LIB", 1 pg, prior 1997.

L.E. Hibbs, Jr., et al. *Diamond Compact Cutter Studies for Geothermal Bit Design*, Nov. 1978.

M.C. Sheppard, et al., "*Forces at the Teeth of a Drilling Rollercone Bit: Theory and Experiment*", Proceedings: 1988 SPE Annual Technical Conference and Exhibition; Houston, TX, USA, Oct. 2-5, 1988, vol. Delta, 1988, pp. 253-260 18042, XP002266080, Soc. Pet Eng AIME Pap SPE 1988 Publ by Soc of Petroleum Engineers of AIME, Richardson, TX, USA, 1988.

Adam T. Bourgoyne Jr et. al., "*Applied Drilling Engineering*", Society of Petroleum Engineers Textbook Series, 1991.
Plaintiff's Original Complaint for Patent Infringement and Jury Demand, filed Sep. 6, 2002 in the United States District Court for the Eastern District of Texas, Sherman Division, Civil Action No. 4-02CV269, *Halliburton Energy Services, Inc.* v. *Smith International, Inc.*, 4 pages.
Answer and Counterclaim of Smith International, filed Mar. 14, 2003, in the United States District Court for the Eastern District of Texas, Sherman Division, Civil Action No. 4-02CV269, *Halliburton Energy Services, Inc.* v. *Smith International, Inc.*, 6 pages.
Response of Plantiff and Counterclaim Defendant to Defendant's Counterclaim of Declaratory Judgment filed Apr. 3, 2003, in the United States District Court for the Eastern District of Texas, Sherman Division, Civil Action No. 4-02CV269, *Halliburton Energy Services, Inc.* v. *Smith International, Inc.*, 3 pages.
First Amended Answer and Couterclaim of Smith International, filed Oct. 9, 2003, in the United States District Court for the Eastern District of Texas, Sherman Division, Civil Action No. 4-02CV269, *Halliburton Energy Services, Inc.* v. *Smith International, Inc.*, 8 pages.
J. P. Nguyen, "*Oil and Gas Field Development Techniques: Drilling*" (translation 1996, from French original 1993).
T.M. Warren et al., "*Drag-Bit Performance Modeling*", SPE Drill Eng. Jun. 1989, vol. 4, No. 2, pp. 119-127 15618, XP002266079.
"*Making Hole*", part of Rotary Drilling Series, edited by Charles Kirkley, 1983.
T.M. Warren,"*Factors Affecting Torque for A Roller Cone Bit*", JPT J PET Technol Sep. 1984, vol. 36, No. 10, pp. 1500-1508, XP002266078.
"*Drilling Mud*", part of Rotary Drilling Series, edited by Charles Kirkley, 1984.
H.G. Bentson, "*Rock Bit Design, Selection and Evaluation*", presented at the spring meeting of the pacific coast district, American Petroleum Institute, Division of Production, Los Angeles, May 1956.
Memorandum Opinion of Judge Davis, signed Feb. 13, 2004, in the United States District Court for the Eastern District of Texas, Sherman Division, Civil Action No. 4-02CV269, *Halliburton Energy Services, Inc.* v. *Smith International, Inc.*, 37 pages (including fax coversheet), Feb. 19, 2004.
Final Judgement of Judge Davis, signed Aug. 13, 2004, in the United States District Court for the Eastern District of Texas, Sherman Division, Civil Action No. 4-02CV269, *Halliburton Energy Services, Inc.* v. *Smith International, Inc.*, 3 pages.
Sworn written statement of Stephen Steinke and Exhibits SS-1 to SS-6, Oct. 13, 2004.
Approved Judgment before Ho. Pumfrey, High Court of Justice, Chancery Division, Patents Court, Case HC04C00114, 00689, 00690, (*Halliburton* v. *Smith Internl.*), Royal Courts of Justice, Strand, London, (84 pages), Jul. 21, 2005.
J.C. Estes, "*Selecting the Proper Rotary Rock Bit*", Journal of Petroleum Technology, pp. 1359-1367, Nov. 1971.
D.K. Ma, *A New Method for characterizing the scraping-chiseling performance of rock bits*, Jul. 1988 (English translations with original Chinese version attached).
Wilson C. Chin, *Wave Propagation in Petroleum Engineering*, 1994.
Sikarskie, et al., "*Penetration Problems in Rock Mechanics*", American Society of Mechanical Engineers, Rock Mechanics Symposium, 1973.
Dykstra, et al., "*Experimental Evaluations of Drill String Dynamics*", Amoco Report No. SPE 28323, 1994.
Kenner and Isbell, "*Dynamic Analysis Reveals Stability of Roller Cone Rock Bits*", SPE 28314, 1994.
Brochure entitled "*Twist & Shout*", (SB2255.1001), 4 pages.
Drawing No. A46079 Rock Bit and Hole Opener; Security Engineering Co., Inc., Whittier, California, Sep. 14, 1946.
"Machino Export", Russia, 4 pages, 1974.
R.K. Dropek, "A Study to Determine Roller Cone Cutter Offset Effects at Various Drilling Depths" American Society of Mechanical Engineers, 10 pages, Aug. 1, 1979.
U.S. Appl. No. 10/325,650, filed Dec. 19, 2002 by John G. Dennis, entitled Drilling with Mixed Tooth Types.
British Search Report for GB Patent Application No. 0504304.7, 4 pgs, Apr. 22, 2005.
British Search Report for GB Patent Application No. 0503934.2, 3 pgs, May 16, 2005.
B.L. Stcklyanov, et al, "*Improving the Effectiveness of Drilling Tools*," Series KhM-3, Oil Industry Machine Building, pub. Central Institute for Scientific and Technical Information and Technical and Economic Research on Chemical and Petroleum Machine Building, Tsintikhimneftemash, Moscow translated from Russian), 1991.
Energy Balanced Series Roller Cone Bits, www.halliburton.com/oil_gas/sd1380.jsp.
Ashmore, et al., Stratapax™ Computer Program, Sandia Laboratories, Albuquerque, NM, (76 pages).
F.A.S.T.™ Technology Brochure entitled "*Tech Bits*", Security/Dresser Industries (1 page), Sep. 17, 1993.
Sii PLUS Brochure entitled "*The PDC Plus Advantage*", from Smith International (2 pages).
Specification sheet entitled "*SQAIR Quality Sub-Specification*", Shell Internationale Petroleum Mij. B.V., The Hauge, The Netherlands, 1991 (2 Pages).
Brochure entitled "*FM2000 Series—Tomorrow's Technolgoies for Today's Drilling*.", Security DBS, Dresser Industries, Inc., 1994 ( Pages).
Brochure entitled "*FS2000 Series-New Steel Body Technology Advances PDC Bit Performances and Efficiency*", Security DBS, Dresser Industries, Inc. (6 pages), 1997.
Communication of a Notice of Opposition filed Oct. 14, 2004, with the European Patent Office, mailed Oct. 21, 2004.
Brief Communication from European Patent Office enclosing letter from the opponent of Oct. 13, 2004, Oct. 22, 2004.
Composite Catalog of Oil Filed Equipment & Services, 27th Revision 1666-67 vol. 3, 1966.
Lecture Handouts, *Rock Bit Design, Dull grading, Selection and Application*, presented by Reed Rock bit Company, Oct. 16, 1980.
*Longer Useful Lives for Roller Bits Cuts Sharply into Drilling Costs*, South African Mining & Engineering Journal, vol. 90, pp. 39-43, Mar. 1979.
Rabia, H., *Oilwell Drilling Engineering: Principles and Practice*, University of Newcastle upon Tyne, 331 pages, 1985.
Brief Communication from European Patent Office enclosing letter from the opponent dated Dec. 2, 2004 (074263.0281).
W.C. Maurer, "The Perfect-Cleaning Theory of Rotary Drilling", Journal of Petroleum Technology, SPE, pp. 1270-1274, Nov. 1962.
Notification of European Search Report for Patent application No. 04025232.5-2315, pages, Apr. 4, 2006.
Notification of European Search Report for Patent application No. 04025234.8-2315, 3 pages, Apr. 4, 2006.
Notification of European Search Report for Patent application No. 04025233.0-2315, 3 pages, Apr. 11, 2006.
Ma. D., et al. "*A New Method for Designing Rock Bit*", SPE Proceedings, vol. 22431, XP008058830, 10 pages, Mar. 24, 1992.
Notification of Great Britain Search Report for Application No. GB 0516638.4 (4 pages), Jan. 5, 2006.
Notification of Great Britain Search Report for Application No. GB 0523735.9 (3 pages), Jan. 31, 2006.
Communication from European Patent Office regarding opposition; Application No. 99945376.4-1266/1117894 through the Munich office (5 pages), Feb. 15, 2006.
Notification of European Search Report for Patent Application No. EP 04025560.6-2315 (4 pages), Feb. 24, 2006.
Notification of European Search Report for Patent Application No. EP 04025561.4-2315 (4 pages), Feb. 24, 2006.
Notification of European Search Report for Patent Application No. EP 04025562.2-2315 (4 pages), Feb. 24, 2006.
Notification of European Search Report for Patent Application No. EP 04025232.2-2315 (4 pages), Feb. 24, 2006.
Sutherland et al. "Development & Application of Versatile and Economical 3D Rotary Steering Technology" AADE, Emerging Technologies (pp. 2-16), 2001.

International Search Report, PCT/US2006/030830, 11 pages, mailing date Dec. 19, 2006.
Menand et al., Classification of PDC Bits According to their Steerability, SPE, 11 pgs, 2003.
International Search Report, PCT/US2006/030803, 11 pgs, mailing date, Dec. 19, 2006.
Hare et al., Design Index: A Systematic Method of PDC Drill-Bit Selection, SPE, 15 pgs, 2000.
Halliburton Revolutionizes PDC Drill Bit Design with the Release of FM3000, 2003 Press Releases, 2 pgs, Aug. 8, 2005.
D Stroud et al., "Development of the Industry's First Slimhole Point-the-Bit Rotary Steerable System," Society of Petroleum Engineers Inc, 4 pgs, 2003.
J.A. Norris, et al., "Development and Successful Application of Unique Steerable PDC Bits," Copyright 1998 IADC/SPE Drilling Confrence, 14 pgs, Mar. 3, 1998.
O. Vincke, et al., "Interactive Drilling: The Up-To-Date Drilling Technology," Oil & Gas Science and Technology Rev. IFP, vol. 59, No. 4, pp. 343-356, Jul. 2004.
Halliburton catalogue item entitled: EZ-Pilot (TM) Rotary Steerable System (1 page), Jul. 24, 2006.
Halliburton catalogue item entitled: Geo-Pilot (R) Rotary Steerable System (1 page), Jul. 24, 2006.
Halliburton catalogue item entitled: SlickBore (R) Matched Drilling System (1 page), Jul. 24, 2006.
Patent Acts 1977: Error in Search Report, Application No. GB0516638.4, 2 pgs, May 24, 2006.
Decision revoking European Patent No. EP-B-1117894, 16 pgs, May 15, 2006.

* cited by examiner

FIG. 1
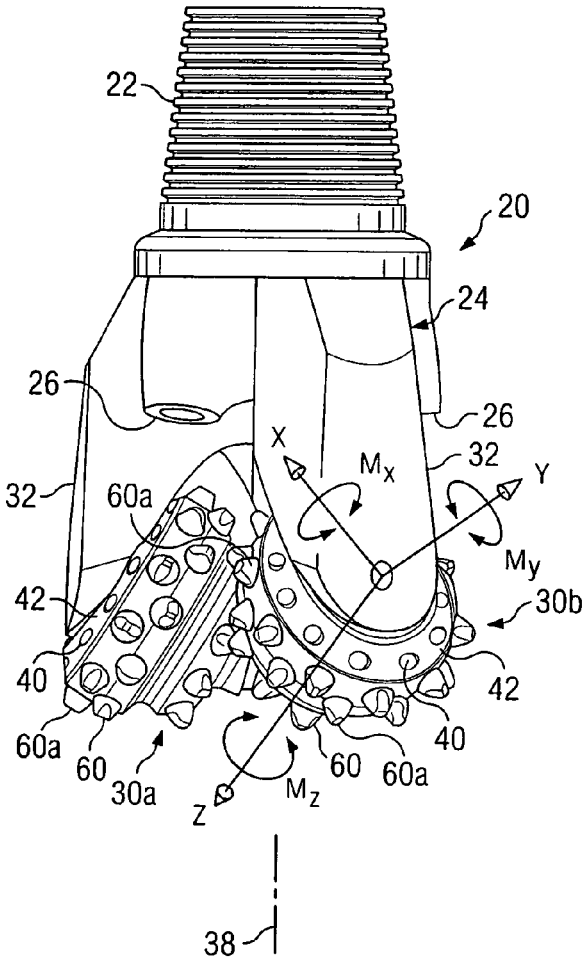
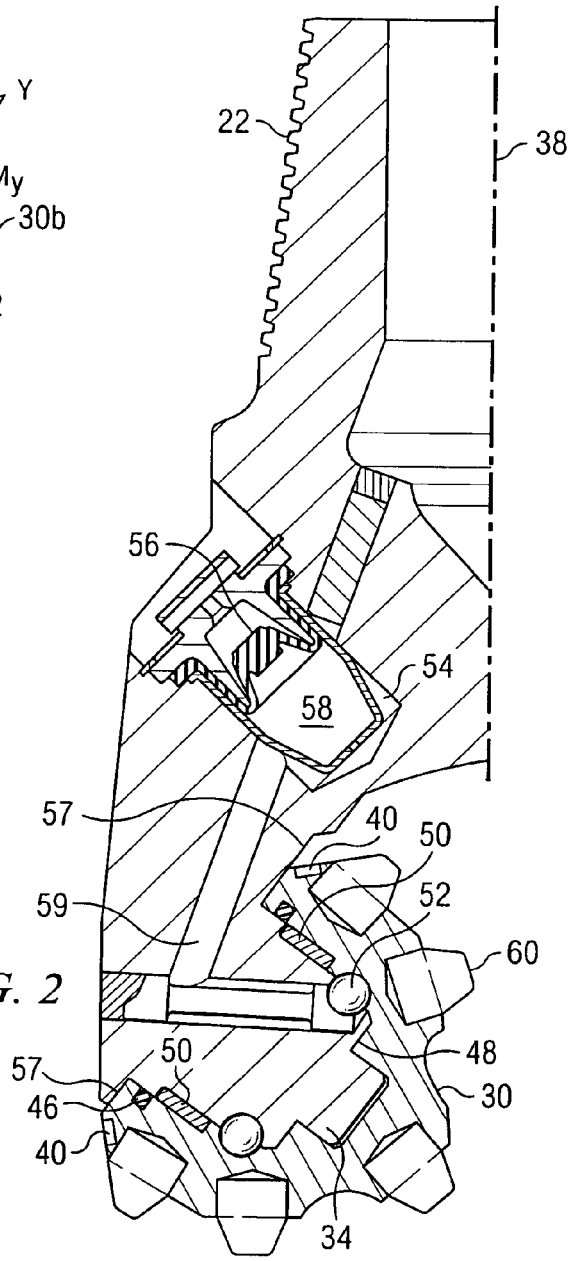
FIG. 2

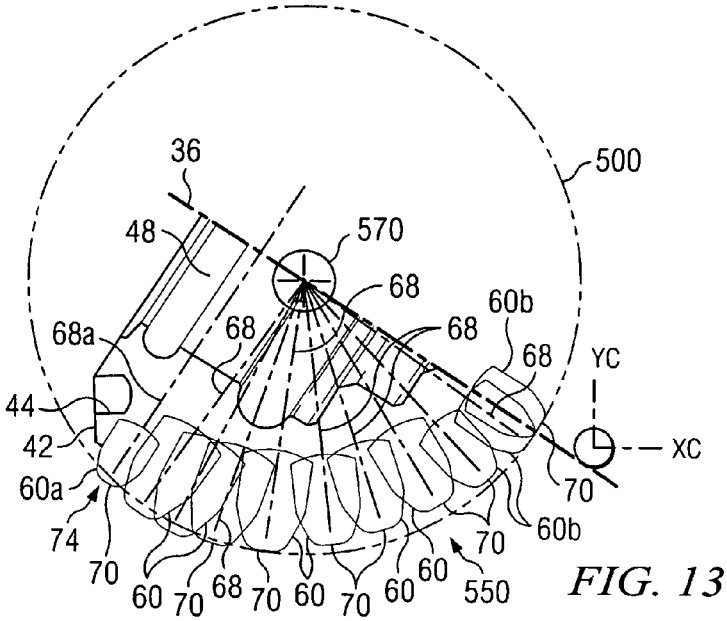
FIG. 13
FIG. 14
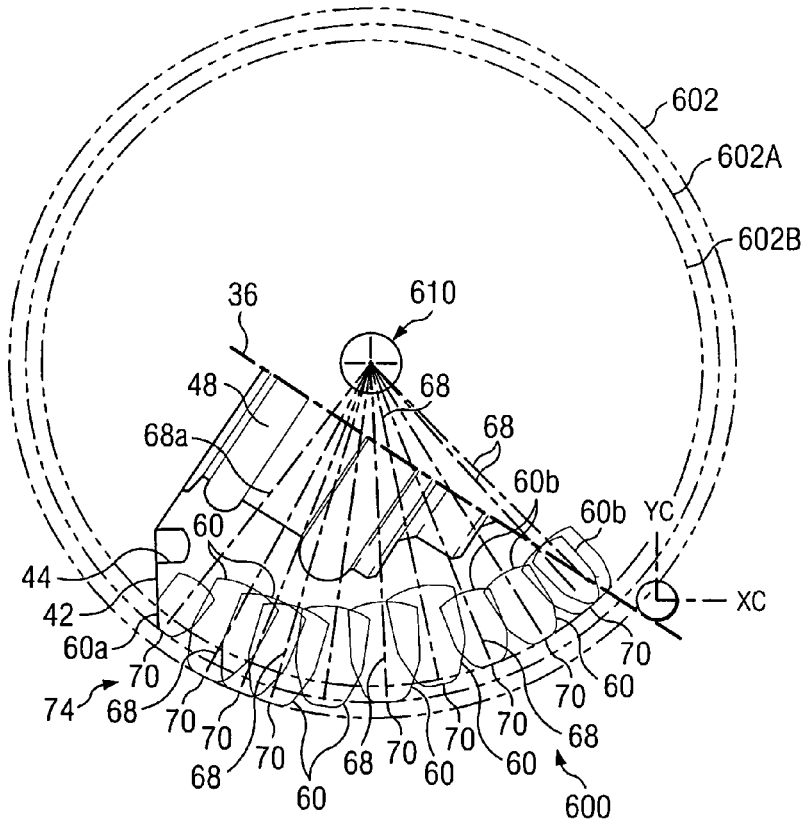

700

2200
2000
1800
1600
1400
1200
1000
800
600
400
712
BEARING MOMENT (ft-lb)
716
MINIMAL POINT AT 0.32"
714
-1.0
-0.5
0.0
0.5
1.0
1.5
2.0
DISTANCE FROM BACKFACE (inch)
710

800
2400
2200
2000
1800
1600
1400
1200
1000
800
600
400
BEARING NUMBER 1
BEARING NUMBER 2
BEARING NUMBER 3
822
818
814
812
BEARING MOMENT (ft-lb)
820
816
824
-1.0
-0.5
0.0
0.5
1.0
1.5
2.0
DISTANCE FROM BACKFACE (inch)
810

828

BEARING NUMBER 1
BEARING NUMBER 2
BEARING NUMBER 3
812
BEARING MOMENT (ft-lb)
2400
2200
2000
1800
1600
1400
1200
1000
800
600
400
838
834
830
836
840
832
-1.0
-0.5
0.0
0.5
1.0
1.5
2.0
DISTANCE FROM BACKFACE (inch)
810

850
BEARING NUMBER 1
BEARING NUMBER 2
BEARING NUMBER 3
812
BEARING MOMENT (ft-lb)
2200
2000
1800
1600
1400
1200
1000
800
600
400
200
864
860
868
866
862
870
-1.0
-0.5
0.0
0.5
1.0
1.5
2.0
DISTANCE FROM BACKFACE (inch)
810

880

BEARING NUMBER 1
BEARING NUMBER 2
BEARING NUMBER 3
812
BEARING MOMENT (ft-lb)
2200
2000
1800
1600
1400
1200
1000
800
600
400
200
890
886
882
888
884
892
-1.0
-0.5
0.0
0.5
1.0
1.5
2.0
DISTANCE FROM BACKFACE (inch)
810

900 x10^4
FORCE AT POINT A OF BEARING NUMBER 1
FORCE AT POINT B OF BEARING NUMBER 1
912
FORCES AT BEARING SUPPORT ENDS
2.5
2.0
1.5
1.0
0.5
0.0
926
928
920
922
924
936
938
930
932
934
BIT C
BIT D
BIT A
BIT B
0.30
0.35
0.40
0.45
0.50
0.55
0.60
0.65
0.70
DISTANCE OF MINIMUM MOMENT POINT OF BEARING CENTER, INCH
910

940 x10^4
2.5
2.0
1.5
1.0
0.5
0.0
FORCES AT BEARING SUPPORT ENDS
946
BIT C
950
958
952
954
956
964
962
968
960
966
BIT A
BIT B
BIT D
FORCE AT POINT A OF BEARING NUMBER 2
FORCE AT POINT B OF BEARING NUMBER 2
0.30
0.35
0.40
0.45
0.50
0.55
0.60
0.65
0.70
DISTANCE OF MINIMUM MOMENT POINT OF BEARING CENTER INCH
942

970 x10^4
2.5
2.0
1.5
1.0
0.5
0.0
FORCES AT BEARING SUPPORT ENDS
974
BIT A
BIT D
BIT C
984
980
982
988
986
994
990
998
992
BIT B
996
FORCE AT POINT A OF BEARING NUMBER 3
FORCE AT POINT B OF BEARING NUMBER 3
0.1
0.2
0.3
0.4
0.5
0.6
0.7
DISTANCE OF MINIMUM MOMENT POINT OF BEARING CENTER, INCH
972

ROLLER CONE DRILL BITS WITH OPTIMIZED BEARING STRUCTURES

RELATED APPLICATIONS

This application claims the benefit of U.S. Provisional Patent Application entitled "Roller Cone Drill Bits with Optimized Bearing Structures," application Ser. No. 60/601,952 filed Aug. 16, 2004.

This Application is related to copending U.S. application Ser. No. 10/919,990 filed Aug. 17, 2004 which claims the benefit of U.S. Provisional Patent Application Ser. No. 60/549,339 filed Mar. 2, 2004 entitled, Roller Cone Drill Bits with Enhanced Drilling Stability and Extended Life of Associated Bearings and Seals and U.S. Continuation-In-Part application Ser. No. 11/054,395 filed Feb. 9, 2005 which claims the benefit of U.S. Provisional Patent Application Ser. No. 60/549354 filed Mar. 2, 2004 entitled, Roller Cone Drill Bits with Enhanced Cutting Elements and Cutting Structures.

TECHNICAL FIELD

The present invention is related to roller cone drill bits used to form wellbores in subterranean formations and more particularly to the arrangement and design of bearing structures and cutting structures to enhance drilling stability and extend the life of associated bearings and seals.

BACKGROUND

A wide variety of roller cone drill bits have previously been used to form wellbores in downhole formations. Such drill bits may also be referred to as "rotary" cone drill bits. Roller cone drill bits frequently include a bit body with three support arms extending therefrom. A respective cone assembly is generally rotatably mounted on each support arm opposite from the bit body. Such drill bits may also be referred to as "rock bits".

A wide variety of roller cone drill bits have been satisfactorily used to form wellbores. Examples include roller cone drill bits with only one support arm and one cone, two support arms with a respective cone assembly rotatably mounted on each arm and four or more cones rotatably mounted on an associated bit body. Various types of cutting elements and cutting structures such as compacts, inserts, milled teeth and welded compacts have also been used in association with roller cone drill bits.

Cutting elements and cutting structures associated with roller cone drill bits typically form a wellbore in a subterranean formation by a combination of shearing and crushing adjacent portions of the formation. Roller cone drill bits often operate at relatively low speeds with heavy load applied to the bit. This produces very high loads on the associated bearing structures, increasing wear on the bearing structure and directly impacting the life of the bearing. In many cases, bearing life determines bit life. Therefore, design of bearing structure is often a key issue for roller cone bit manufacturers.

Three major types of bearings are frequently used in the roller cone bit industry: journal bearings (also referred to as a friction bearing), roller bearings and solid bearings. The arrangement and configuration of bearings associated with a roller cone drill bit may be referred to as a "bearing system," "bearing assembly" or "bearing structure."

A roller bearing system includes one or more rollers. For example, one type of roller bearing system is a roller-ball-roller-roller bearing structure. Other roller bearing systems incorporate various combinations of roller and ball bearing components and may include, for example, a roller-ball-roller structure or a roller-ball-friction structure. With only limited space available in a typical roller cone assembly for a bearing structure, the proper balance between the size of roller and ball bearings must be maintained in order to prevent excessive wear or premature failure of any elements.

A journal bearing, which has been implemented into roller cone bits since approximately 1970, typically includes a journal bushing, a thrust flange and ball bearing. The journal bushing is used to bear some of the forces transmitted between the journal and the cone assembly. The thrust flange typically bears the load parallel to the journal axis (axial load). Efforts have been made to increase the load carrying capability of the bearing including those discussed in U.S. Pat. No. 6,260,635 entitled, Rotary Cone Drill Bit with Enhanced Journal Bushing and U.S. Pat. No. 6,220,374 entitled, Rotary Cone Drill Bit with Enhanced Thrust Bearing Flange.

A solid bearing is similar to journal bearing but does not include the bushings and flange of a typical journal bearing. Instead of using bushing and flange, a wear resistant hard material such as natural and synthetic diamond, polycrystalline diamond (PCD) may be used to increase the wear resistance of associated bearing surfaces.

The design of bearing systems and bearing structures within roller cone drill bits is typically driven by a designer's field observations and years of experience. Load distribution on bearings are usually estimated by assuming the magnitude of the forces acting on associated cutting structures such as rows of teeth and/or inserts. In instances in which the cutting structures of roller cones vary, an assumption is usually made that the design of a bearing structure is suitable for many cutting structures as long as basic characteristics such as bit diameter, bearing angle and offset are the same. Current industry practice is that for a particular of roller cone drill bit, the same size and type of bearing structure may be used for each associated cone assembly.

SUMMARY OF THE DISCLOSURE

Therefore, a need has arisen for a design method that accounts for variations in cutting structures of a rotary cone drill bit and provides bearing assemblies designed to optimize performance of the drill bit. A further need has arisen to reduce bearing load by optimally designing both cutting structures and bearing structures associated with a rotary cone drill bit.

In accordance with teachings of the present disclosure, a roller cone drill bit may be provided with optimally designed bearing structures to substantially reduce or eliminate problems associated with existing bearing structures and to increase the drilling life of associated bearings and seal assemblies. The roller cone drill bit may include a cone assembly with a distinct cutting structure rotatably mounted to a spindle via a bearing structure. Each cone assembly may have a minimal moment center located along a respective axis of rotation. The minimal moment center is defined by characteristics of the respective distinct cutting structure. Each bearing structure includes a respective geometric bearing center point based on the location of each bearing relative to the bearing axis of the spindle. The minimal moment center of the associated cone assembly may be designed to be proximate the geometric bearing center point to overcome problems associated with previous roller cone drill bits and methods of manufacturing and designing roller cone drill bits.

In one aspect, a roller cone drill bit may include a bit body having a first support arm, a second support arm, and a third support arm, where each support arm includes an interior surface and a spindle extending from the interior surface. A bearing structure is associated with each spindle and a cone assembly is rotatably mounted on each bearing structure for engagement with a subterranean formation to form a wellbore. Additionally, each cone assembly has a distinct cutting structure and a respective axis of rotation extending from the associated support arm and corresponding with the longitudinal axis of each respective spindle. Each cone assembly has a minimal moment center located along the respective axis of rotation that is defined by each respective distinct cutting structure. Each respective bearing structure has a center point located proximate to the respective cone assembly.

In another aspect, a roller cone drill bit is disclosed including a bit body with a first support arm, a second support arm, and a third support arm, where each support arm has an interior surface with a spindle extending therefrom. A respective bearing structure is associated with each spindle and a respective cone assembly is rotatably mounted on each bearing structure and provided for engagement with a subterranean formation to form a wellbore, each cone assembly having a distinct cutting structure. Each cone assembly has a respective axis of rotation extending from the associated support arm and corresponding with the longitudinal axis of each respective spindle. Each cone assembly has a minimal moment center located along the respective axis of rotation which is defined by bearing end loads associated with each distinct cutting structure. The respective bearing structures each have a center point located proximate each respective minimal moment center.

In another aspect of the present invention a method is disclosed for forming a roller cone drill bit including forming a bit body that includes a first support arm, a second support arm, and a third support arm where each support arm has an interior surface with a spindle extending therefrom. Next, a first cone assembly with a first cutting structure, a second cone assembly with a second cutting structure, and a third cone assembly with a third cutting structure are provided. The method further includes determining: a first minimal moment center along a first axis of rotation of the first spindle based on the first cone assembly cutting structure, a second minimal moment center along a second axis of rotation of the second spindle based on the second cone assembly cutting structure, and a third minimal moment center along a third axis of rotation of the third spindle based on the third cone assembly cutting structure. The first bearing assembly is then disposed on the first spindle with the center of the first bearing assembly disposed proximate the first minimal moment center. The second bearing is then disposed on the second spindle with the center of the second bearing assembly disposed proximate the second minimal moment center. The third bearing is then disposed on the third spindle with the center of the third bearing assembly disposed proximate the third minimal moment center.

The present invention includes a number of technical benefits such as providing bearing structures with center points located proximate to a minimal moment center of an associated cone assembly. Minimizing any displacement between each center point and the associated minimal moment center allows each bearing structure to better support an associated cone assembly and reduces the bearing load acting on each cone assembly.

Designing each cutting structure to have a minimal moment center proximate the associated bearing center point reduces the effect of changes in cutting structures between each cone assembly of a rotary cone drill bit.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein:

FIG. 1 is a schematic drawing showing an isometric view of a roller cone drill bit;

FIG. 2 is a schematic diagram in section showing a cone assembly rotatably mounted on a support arm;

FIG. 13 is a schematic drawing showing a composite cone profile for a roller cone according to teachings of the present invention;

FIG. 14 is a schematic diagram showing a composite cone profile for a roller cone according to teachings of the present invention.

DETAILED DESCRIPTION OF THE DISCLOSURE

Figure 3:
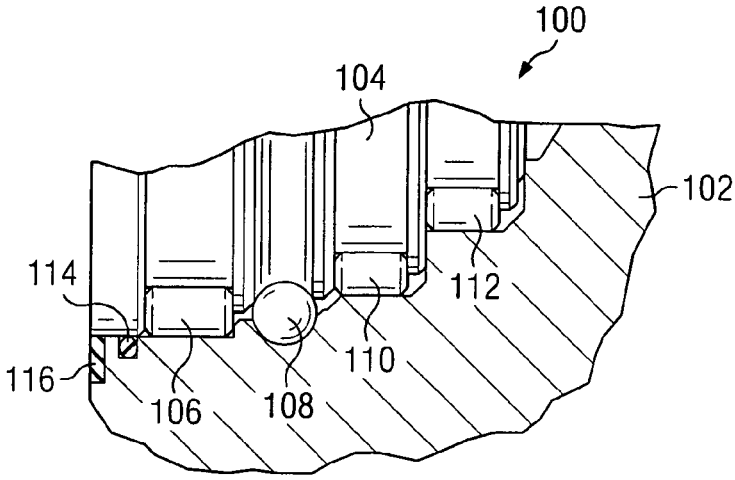
FIG. 3 shows a schematic diagram in section with portions removed of a roller-ball-roller-roller bearing structure disposed between a spindle and a cone assembly.

Preferred embodiments and their advantages are best understood by reference to FIGS. 1-22 wherein like numbers refer to like and corresponding parts.

The terms "cutting element" and "cutting elements" may be used in this application to include various types of compacts, inserts, milled teeth and welded compacts satisfactory for use with roller cone drill bits. The terms "cutting structure" and "cutting structures" may be used in this application to include various combinations and arrangements of cutting elements formed on or attached to one or more cone assemblies of a roller cone drill bit.

The term "cone assembly" may be used in this application to include various types and shapes of roller cone assemblies and cutter cone assemblies rotatably mounted to a drill bit support arm. Cone assemblies may have a conical exterior shape or may have a more rounded exterior shape. In certain embodiments, cone assemblies may incorporate an exterior shape having or approaching a generally spherical configuration.

The term "bearing structure" may be used in this application to include any suitable bearing structure or bearing system satisfactory for rotatably mounting a cone assembly on a spindle. For example, a "bearing structure" may include the requisite structure including inner and outer races and bushing elements to form a journal bearing, a roller bearing (including, but not limited to a roller-ball-roller-roller bearing, a roller-ball-roller bearing, and a roller-ball-friction bearing) and a solid bearing. Additionally, a bearing structure may include interface elements such a bushings, rollers, balls, and areas of hardened materials used for interfacing with a roller cone. A bearing structure may also be referred to as a "bearing assembly" or "bearing system."

The terms "crest" and "longitudinal crest" may be used in this application to describe portions of a cutting element or cutting structure that contacts a formation during drilling of a wellbore. The crest of a cutting element will typically engage and disengage the bottom of a wellbore during rotation of a roller cone drill bit and associated cone assembly. The geometric configuration and dimensions of crests may vary substantially depending upon specific design and dimensions of associated cutting elements and cutting structures.

Cutting elements generally include a "crest point" defined as the center of the "cutting zone" for each cutting element. The location of the cutting zone depends on the location of the respective cutting element on the associated cone assembly. The size and configuration of each cutting element also determines the location of the associated cutting zone. Frequently, the cutting zone is disposed adjacent to the crest of a cutting element. For some applications, cutting elements and cutting structures may be formed in accordance with teachings of the present invention with relatively small crests or dome shaped crests. Such cutting elements and cutting structures will typically have a crest point located proximate the center of the dome. Cutting elements and cutting structures formed in accordance with teachings of the present invention may have various designs and configurations.

The term "cone profile" may be defined as an outline of the exterior surface of a cone assembly and all cutting elements associated with the cone assembly projected onto a vertical plane passing through an associated cone rotational axis. Cone assemblies associated with roller cone drill bits typically have generally curved, tapered exterior surfaces. The physical size and shape of each cone profile depends upon various factors such as the size of an associated drill bit, cone rotational angle, offset of each cone assembly and size, configuration and number of associated cutting elements.

Roller cone drill bits typically have "composite cone profiles" defined in part by each associated cone profile and the crests of all cutting elements projected onto a vertical plane passing through a composite axis of rotation for all associated cone assemblies. Composite cone profiles for roller cone drill bits and each cone profile generally include the crest point for each associated cutting element.

Various types of cutting elements and cutting structures may be formed on a cone assembly. Each cutting element will typically have a normal force axis extending from the cone assembly. The term "cutting element profile angle" may be defined as an angle formed by the cutting element's normal force axis and associated cone rotational axis. For some roller cone drill bits the cutting element profile angle for cutting elements located in associated gauge rows may be approximately ninety degrees (90°).

Figure 19:
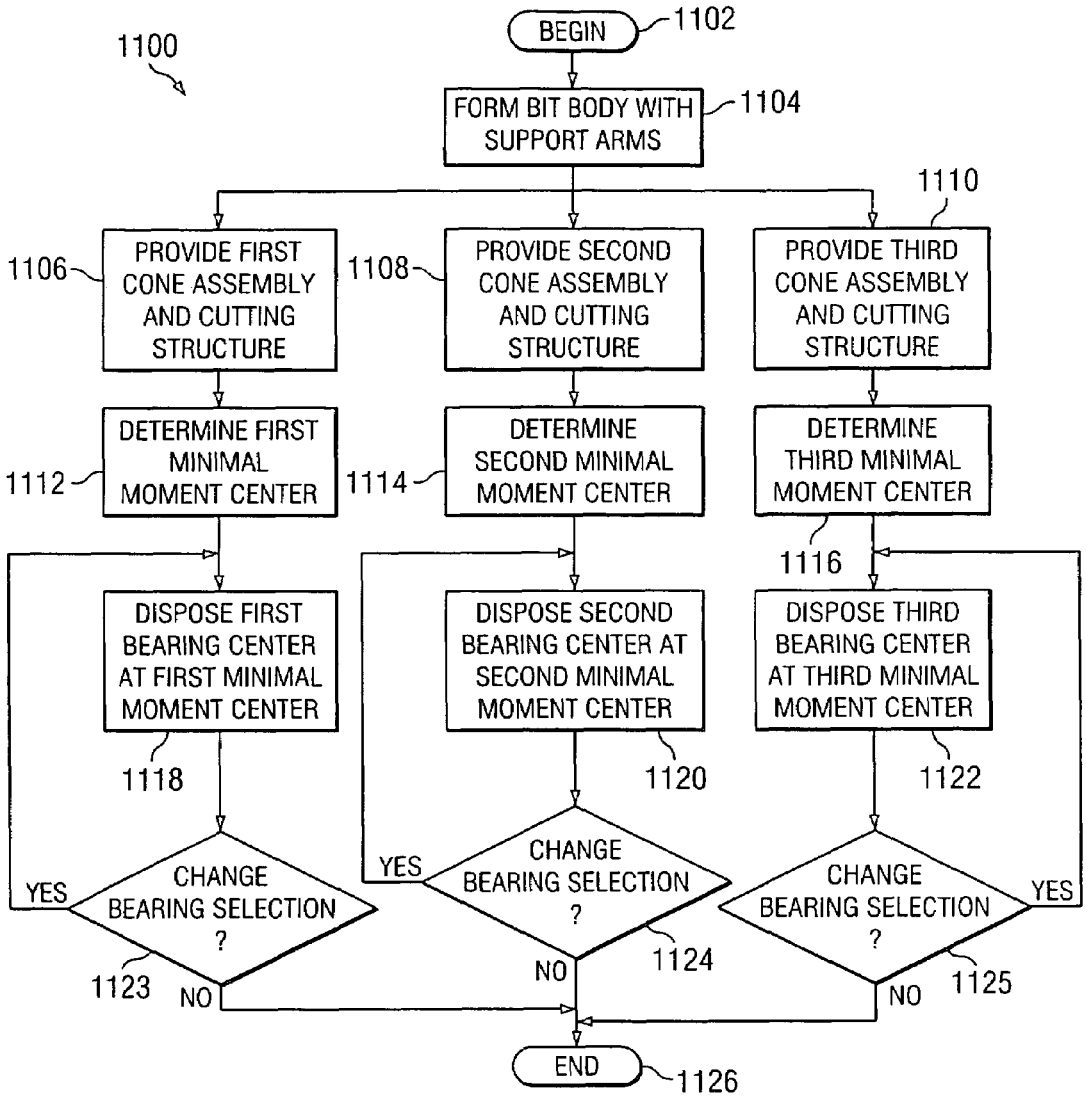
FIG. 19 is a flow diagram showing a method of forming a drill bit according to teachings of the present invention.

Now referring to FIG. 1, a roller cone drill bit 20 with multiple cone assemblies 30 and cutting elements 60 is shown. Roller cone drill bit 20 may be used to form a wellbore in a subterranean formation (not expressly shown). Roller cone drill bits such as drill bit 20 typically form wellbores by crushing or penetrating a formation and scraping or shearing formation materials from the bottom of the wellbore using cutting elements 60. The present invention may be used with roller cone drill bits having cutting elements in the form of inserts (as shown in FIG. 1) or with roller cone drill bits having milled teeth (as shown in FIG. 19). The present invention may also be used with roller cone drill bits having cutting elements (not expressly shown) welded to or otherwise formed on the associated cone assemblies.

A drill string (not expressly shown) may be attached to threaded portion 22 of drill bit 20 to both rotate and apply weight or force to associated cone assemblies 30 as they roll around the bottom of a wellbore. For some applications various types of downhole motors (not expressly shown) may also be used to rotate a roller cone drill bit incorporating teachings of the present invention. The present invention is not limited to roller cone drill bits associated with conventional drill strings.

For purposes of describing various features of the present invention, cone assemblies 30 are more particularly identified as 30*a*, 30*b* and 30*c*. Cone assemblies 30 may also be referred to as "rotary cone cutters", "roller cone cutters" or "cutter cone assemblies". Cone assemblies 30 associated with roller cone drill bits generally point inwards towards each other. The cutting elements typically include rows of cutting elements 60 that extend or protrude from the exterior of each cone assembly.

Roller cone drill bit 20, includes bit body 24 having tapered, externally threaded portion 22 adapted to be secured to one end of a drill string. Bit body 24 preferably includes a passageway (not expressly shown) to communicate drilling mud or other fluids from the well surface through the drill string to attached drill bit 20. Drilling mud and other fluids may exit from nozzles 26. Formation cuttings and other debris may be carried from the bottom of a borehole by drilling fluid ejected from nozzles 26. Drilling fluid generally flows radially outward between the underside of roller cone drill bit 20 and the bottom of an associated wellbore. The drilling fluid may then flow generally upward to the well surface through an annulus (not expressly shown) defined in part by the exterior of roller cone drill bit 20 and associated drill string and the inside diameter of the wellbore.

In the present embodiment, bit body 24 includes three (3) support arms 32 extending therefrom. The lower portion of each support arm 32 opposite from bit body 24 preferably includes a respective spindle or shaft 34 (as shown in FIG. 2). Each cone assembly 30*a*, 30*b* and 30*c* preferably includes a cavity (not expressly shown) dimensioned and configured to receive an associated spindle or shaft.

Cone assemblies 30*a*, 30*b* and 30*c* are rotatably attached to the respective spindles extending from support arms 32. Cone assemblies 30*a*, 30*b* and 30*c* each have an axis of rotation 36, sometimes referred to as "cone rotational axis", (as shown in FIG. 2). Axis of rotation 36 of a cone assembly 30 preferably corresponds with the longitudinal center line of an associated spindle 34 which may also be referred to as the "Z-axis" of the spindle or as the bearing axis. Cutting or drilling action associated with drill bit 20 occurs as cutter cone assemblies 30*a*, 30*b* and 30*c* roll around the bottom of a wellbore. The diameter of the resulting wellbore corresponds approximately with the combined outside diameter or gauge diameter associated with cutter cone assemblies 30*a*, 30*b* and 30*c*.

A plurality of compacts 40 may be disposed in back face 42 of each cone assembly 30*a*, 30*b* and 30*c*. Compacts 40 may be used to "trim" the inside diameter of a wellbore to prevent other portions of back face 42 from contacting the adjacent formation. A plurality of cutting elements 60 may also be disposed on the exterior of each cone assembly 30*a*, 30*b* and 30*c* in accordance with teachings of the present invention.

Compacts 40 and cutting elements 60 may be formed from a wide variety of hard materials such as tungsten carbide. The term "tungsten carbide" includes monotungsten carbide (WC), ditungsten carbide ($W_2C$), macrocrystalline tungsten carbide and cemented or sintered tungsten carbide. Examples of hard materials which may be satisfactorily used to form compacts 40 and cutting elements 60 include various metal alloys and cermets such as metal borides, metal carbides, metal oxides and metal nitrides.

Rotational axes 36 of cone assemblies 30*a*, 30*b* and 30*c* are preferably offset from each other and from rotational axis 38 of roller cone bit 20. Axis of rotation 38 of roller cone drill bit 20 may sometimes be referred to as "bit rotational axis". The weight of an associated drill string (sometimes referred to as "weight on bit") will generally be applied to drill bit 20 along bit rotational axis 38. For some applications, the weight on bit acting along the bit rotational axis 38 may be described as the "downforce". However, many wells are drilled at an angle other than vertical. Wells are frequently drilled with horizontal portions (sometimes referred to as "horizontal wellbores"). The forces applied to drill bit 20 by a drill string and/or a downhole drilling motor will generally act upon drill bit 20 along bit rotational axis 38 without regard to vertical or horizontal orientation of an associated wellbore. The forces acting on drill bit 20 and each cutting element 60 are also dependent on formation type.

The cone offset and generally curved cone profile associated with cone assemblies 30*a*, 30*b* and 30*c* result in cutting elements 60 impacting a formation with a crushing or penetrating motion and a scraping or shearing motion.

Now referring to FIG. 2, a cross section of cone assembly 30*a* is shown rotatably mounted on support arm 32. Support arm 32 includes a threaded portion 22 for attaching to the end of a drill string. Support arm 32 further includes a spindle 34 extending an interior surface 57 (which may also be referred to as the "last machine surface) of the lower end of support arm 32. Roller cone 30*a* is rotatably mounted to spindle 34 via bearing structure 40. In the present embodiment, bearing structure includes roller 50 and ball bearing 52. Ball bearing 52 is lubricated by lubrication system 54. Lubrication system 54 includes flexible diaphragm 56 and lubrication reservoir 58. Lubrication is provided to roller cone 30*a* bearing structure 40 via lubricant passage 59.

Cone assembly 30*a* preferably rotates about cone rotational axis 36 which tilts downwardly and inwardly at an angle relative to bit rotational axis 38. As described above, cone rotational axis 36 preferably corresponds with the Z-axis of spindle 34 and the bearing axis of rotation. Elastomeric seal 46 may be disposed between the exterior of spindle 34 and the interior of the cone portion 31 of cone assembly 30. Seal 46 forms a fluid barrier between exterior portions of spindle 34 and interior portions of cone assembly 30 to retain lubricants within the interior cavity of cone assembly 30 and bearing structure 40. Seal 46 also prevents infiltration of formation cuttings into the interior cavity of roller cone 31. Seal 46 protects bearing structure 40 from loss of lubricant and from contamination with debris and thus prolongs the downhole life of drill bit 20.

Bearing structure 40 supports radial loads associated with rotation of cone assembly 30*a* relative to spindle 34. In some embodiments a thrust bearing may be included to support axial loads associated with rotation of cone assembly 30 relative to spindle 34.

Bearing structure 40 may incorporate any bearing structure suitable for rotatably mounting roller cone assembly 30 to spindle 34. For instance, bearing structure 40 may encompass a roller bearing as shown in FIG. 3, a journal bearing as shown in FIG. 4, or a solid bearing as shown in FIG. 5.

Now referring to FIG. 3, cross-sectional depiction, with portions cut away, of a roller bearing 100 is depicted. Roller bearing 100 is provided for rotatable association with a roller cone 102. Roller bearing 100 includes a bearing structure 104 formed to attach to a spindle (such as spindle 34). Bearing structure 104 supports first roller 106, first ball 108, second roller 110 and third roller 112. Roller bearing 100 may also include an interior seal 114 and an exterior seal 116 to retain lubricant within bearing structure 104 and to prevent the invasion of cuttings and drilling fluid. Roller bearing 100 may also be referred to as a roller-ball-roller-roller bearing.

Figure 4:
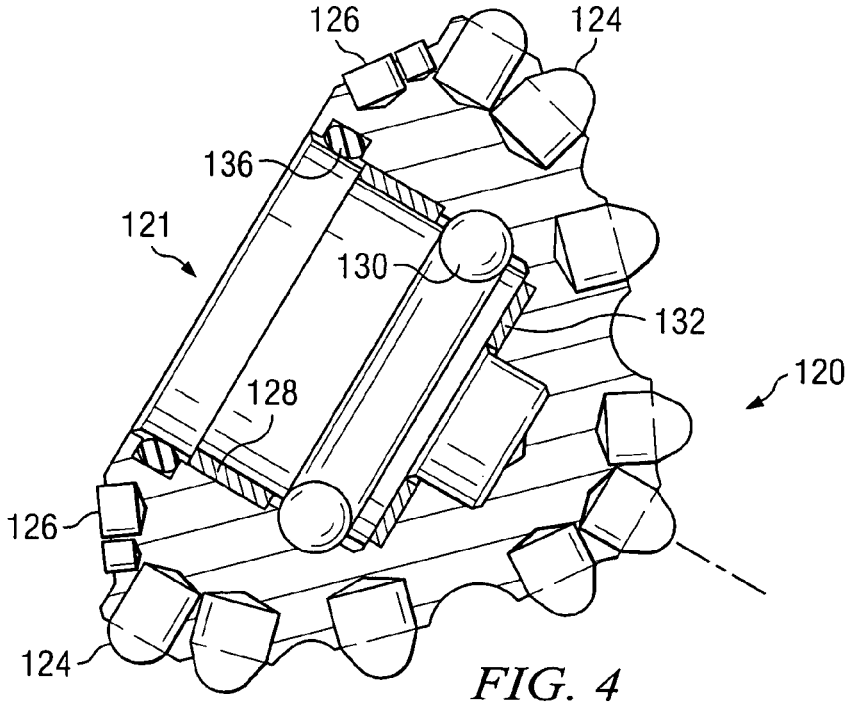
FIG. 4 is a schematic drawing in section with portions broken away showing a journal bearing structure disposed between a spindle and a cone assembly.

Now referring to FIG. 4, a cross section of a journal bearing 120 and roller cone 122 is depicted. Journal bearing 120 includes bearing structure 122 for rotatably mounting roller cone 134. Bearing structure 122 is formed to engage spindle 121 and to support bushing 128, ball 130, and thrust bearing 132, which allow cone 134 to rotatably attach to bearing structure 122. Cone assembly 134 includes a plurality of inserts 124 as well as compacts 126. Elastomeric seal 136 is provided to retain lubricants within bearing structure 122 and to prevent cuttings and drilling fluid from invading bearing structure 122.

Figure 5:
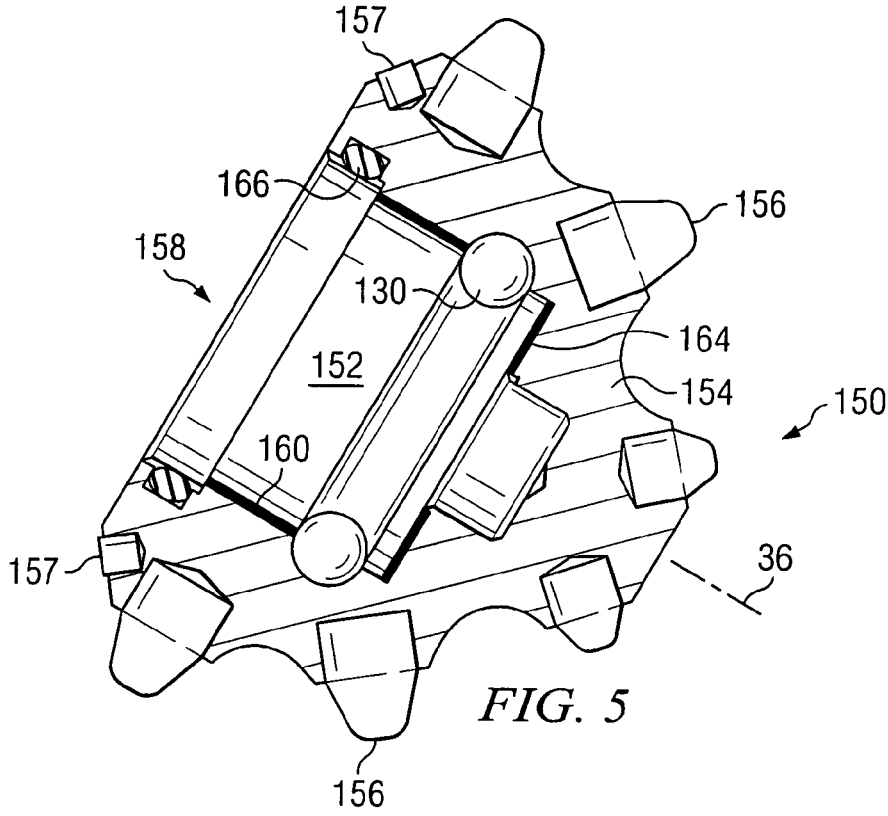
FIG. 5 is a schematic drawing of a roller cone that includes a solid bearing.

Now referring to FIG. 5, a cross section of solid bearing 150 is depicted. Solid bearing 150 includes bearing structure 152 for rotatably mounting cone assembly 154 to spindle 158 and to support ball bearing 162. Bearing structure 152 further includes first hardened surface 160, second hardened surface 164, as well as ball bearing 130. Hardened surfaces 160 and 164 may be any suitable hardening material including, for example, natural or synthetic diamond and polycrystalline diamond (PCD). Cone assembly 154 includes a plurality of inserts 156 and a plurality of compacts mounted thereon.

For the purposes of the present disclosure, the bearing structure used to support roller cones of the present invention are applicable to any suitable bearing structure, including the bearing structures of a roller bearing (as shown in FIG. 3), a journal bearing (as shown in FIG. 4), and a solid bearing (as shown in FIG. 5). Further, each bearing structure 104, 102, and 152 has a center point as further described in FIG. 7 below.

Figure 6:
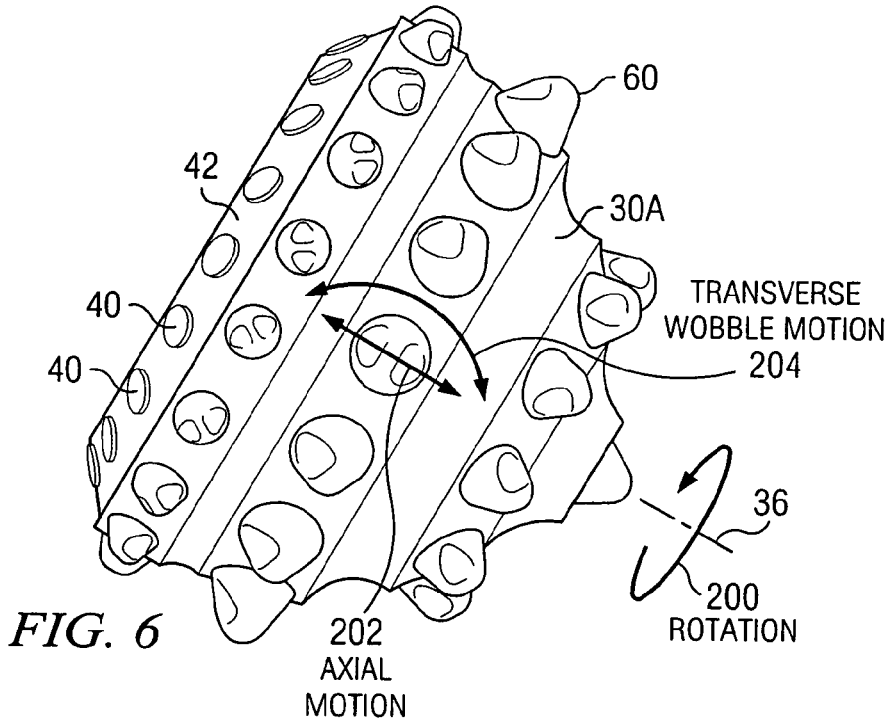
FIG. 6 is a schematic drawing showing a roller cone and indicating possible cone motions associated with the roller cone.

FIGS. 6-10B illustrate some of the forces that may act on roller cones during drilling and the forces that may effect cone wobble. FIG. 6 shows a cone assembly 30 with three rows of inserts 60 and a row of compacts 40 disposed along back face 42. During drilling operations cone assembly 30 preferably rotates about axis of rotation 36 in the direction of rotational direction arrow 200. Additionally, cone assembly 30 may experience axial motion 202 along axis of rotation 36 in the direction of axial motion arrows 20. Axial motion 202 may also be described as longitudinal movement of cone 30A with respect to axis 36. Axis 36 may be considered to be the axis of the spindle, bearing and cone 30A. Due to the various stresses and forces (including moments) acting on cone assembly 30 (as described further herein) cone assembly 30 may "wobble" by experiencing movement, for example, in the direction of transverse wobble motion arrow 204.

Cone wobble motion 204 is typically a combination of cone rotation around axis 36 and cone bending motion. Cone wobble motion is very harmful, especially with respect to bearing seal life. There are many causes of cone wobble motion, including misalignment of bearing axis and cone axis, and wear of bearing surfaces. Also, a large bending moment caused by the design and forces associated with the cutting structure, the bearing structure, or a combination of the cutting structure and the bearing structure may cause wobble motion.

It is known that cone wobble motion is a major cause of the premature bearing seal failure. This is often because wobble motion increases seal wear, allowing cuttings and drilling fluid to invade the bearing and increase bearing wear, and thereby further increase wobble motion. One driving force of cone wobble motion is the bending moment generated by the interaction between the cutting structure and formation. Using the methods described herein, the cutting structure and bearing structure may be designed such that the bending moment may be minimized. Optimizing the design of the cutting structure and bearing structure as described reduces the cone wobble motion and therefore increase the bearing and seal life of the drill bit.

Figure 7A:
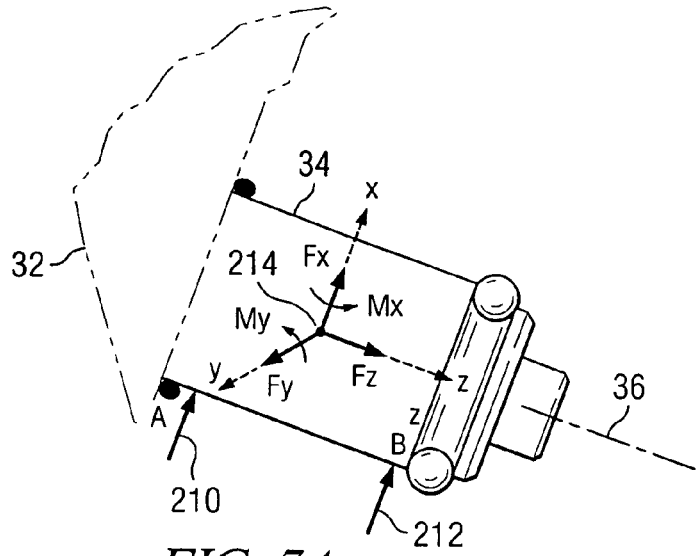
FIG. 7A is a schematic diagram of a spindle showing the forces acting thereon.

Now referring to FIG. 7A, support arm 32 with spindle 34 extending therefrom is shown. Roller cone 30 is not shown in this depiction, however the expectant forces resulting from all the teeth on each cone are summarized to a single point, center point 214 (which may also be referred to as force center 214). Center point 214 corresponds with the center point of the bearing structure of an associated cone assembly. The summarized moment acting on center point 214 is dependent on its location along axis 36. Accordingly, there is a point on the bearing axis at which the bearing moment has a minimum value. As discussed herein, the minimal moment center is a location along the bearing axis where the bending moment has a minimal value and is defined by characteristics of the respective distinct cutting structure.

In the present example embodiment, a model is preferably used to simplify the forces from cone assembly 30 into the x, y and z axis forces 216 and into moments $M_X$ and $M_y$ resolved with respect to center point 214 based upon expected bearing end loads 210 and 212. The model used to predict the forces acting on roller cone 30 may be a computer based simulation. Examples of such simulations are described in U.S. Pat. No. 6,095,262 entitled, Roller-Cone Drill Bits, Systems, Drilling Methods, and Design Methods with Optimization of Tooth Orientation, U.S. Pat. No. 6,412,577 entitled, Roller-Cone Bits, Systems, Drilling Methods, and Design Methods with Optimization of Tooth Orientation, and U.S. Pat. No. 6,213,225 entitled Force-Balanced Roller-Cone Bits, Systems, Drilling Methods, and Design Methods which are hereby incorporated by reference herein.

As shown in FIG. 7A, force A 210 and force B 212 are simplified representations of the forces from roller cone 30 acting on the bearing structure and spindle 34. The position of force A 210 and force B 212 correspond to the points at which the roller cone contacts the bearing structure during drilling, thereby transferring a load to spindle 34. Accordingly, force A 210 and force B 212 may also be referred to as the "bearing ends" or "bearing end loads", as they generally correspond with the ends of the bearing structure. In many instances, force A 210 is greater than force B 212 because force A 210 corresponds with the end of the roller cone that has a larger diameter and is closest to the roller cone's back face. In many instances, the cutting elements and rows of cutting elements located closest to the back face, including the gauge row, act as the primary driver of the roller cone (and therefore generally have the larger forces acting thereon).

The present invention utilizes a bearing force model (which may also be referred to as a "mechanics model") for the calculation of supporting forces 210 and 212 at the bearing ends. One example of a mechanics model is described below with respect to FIGS. 22A-22E. An alternative method to calculate the supporting forces 210 and 212 and their locations are finite element method. In the finite element method, the cone cutting structure, bearing structures are meshed first. The forces (average forces or maximal forces over a time period), acting on each cutting element calculated from the drilling simulation mentioned above, are input to the finite element method. By inputting the material properties such as Young's module, the stress distribution along the bearing surfaces can be determined. Using the stress distribution calculated from finite element method, equivalent point forces at the supporting location or ends of the bearing can be determined. The present invention has found that if the bearing center is coincident with the minimal moment center, bearing end loads 210 and 212 are minimized. Additionally, the location of the minimal moment center is heavily dependent on the cutting structure of the cone. In particular embodiments, the location of the minimal moment point may be dependent on the cone profile and the cutting element profile angle or insert profile angle. As shown for example in FIGS. 11-14 each cutting element or insert may have a respective profile angle defined by the intersection of the respective normal force axis 68*a* or 68 and the associated cone rotational axis 36. Co-pending U.S. patent application Ser. No. 10/919,990 filed Aug. 17, 2004 entitled Roller Cone Drill Bits with Enhanced Drilling Stability and Extended Life of Associated Bearing and Seals is hereby incorporated by reference herein.

At least three general methods may be employed to reduce bearing support forces 210 and 212. First, the cutting structure of each particular cone may be modified such that the forces acting on the cutting structure result in a minimal moment point located proximate the bearing center. The second method is to determine the minimum moment center based on the existing cutting structure and to locate the bearing center proximate to the minimal moment center. The third general approach is to simultaneously change both cutting structure and bearing structure such that the bearing center and the minimal moment center are proximate to one another.

In embodiments in which the roller cones each have a distinct cutting structure, the present invention contemplates that each of the three bearing structures of a single drill bit will have a distinct minimal moment center. Therefore, each of the three roller cone assemblies will be mounted to a distinctly disposed bearing structure as described below. In other words, for a roller cone bit, three distinct bearings are utilized to rotatably connect each roller cone to its respective spindle.

There is a point on the bearing axis (which is also the axis of rotation 36 of roller cone assembly 30) at which the bearing bending moment is minimal (as shown in FIGS. 17A-D). The location of the minimal moment point is influenced greatly by the cutting structure of the roller cone, especially the cone profile and insert profile angles. In order to reduce the bearing bending moment, the bearing structure is then preferably designed such that its bearing center is proximate to the minimal moment center.

Each spindle 34 has a respective bearing center point 214 (which may also be referred to as a "combined bearing center" or a "composite bearing center") based on the location of each bearing relative to the bearing axis 35. The combined or composite bearing center point 214 is a geometric location based on specific dimensions of each spindle 34 the associate bearing supported by spindle.

Figure 7B:
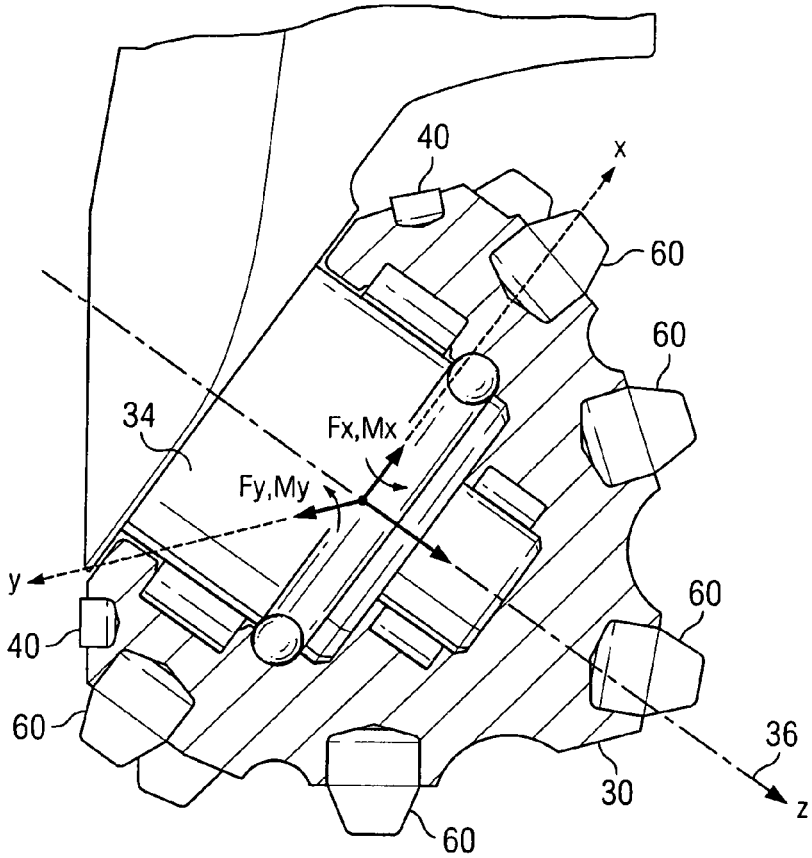
FIG. 7B depicts a roller cone and bearing structure and the forces acting thereon.

Now referring to FIG. 7B, a roller cone 30 is shown rotatably mounted to spindle 34. As shown with respect to FIG. 7A, the resultant forces ($F_x$, $F_y$, $F_z$) and moments ($M_x$, $M_y$) are resolved to location 214 located along Z-axis 36 (which also corresponds with the longitudinal axis of spindle 34 and the axis of rotation of roller cone 30. The forces acting on spindle 34 may be analyzed at any point along Z-axis 36, however, the point at which the moment acting on spindle 34 is minimized is the minimal moment center. In the present embodiment, point 214 preferably corresponds with both the minimal moment center and the bearing center. Locating the minimal moment center proximate the bearing center reduces the moment acting on the spindle thereby reducing the likelihood of cone wobble.

Figure 8A:
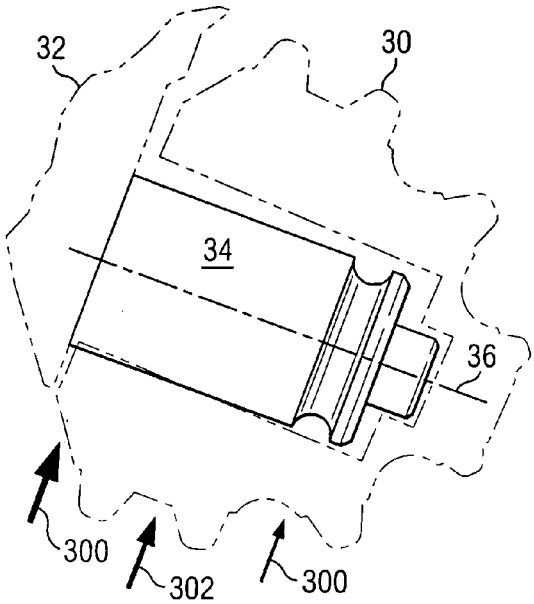
FIG. 8A shows the interaction between a roller cone and a bearing structure with forces acting thereon.
Figure 8B:
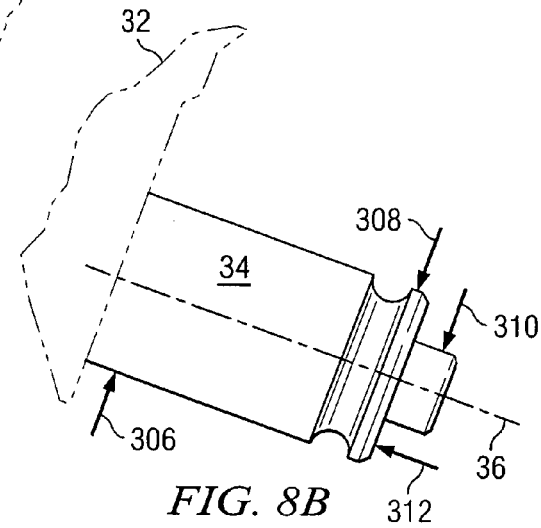
FIG. 8B shows the bearing structure and the forces acting thereon.
Figure 9A:
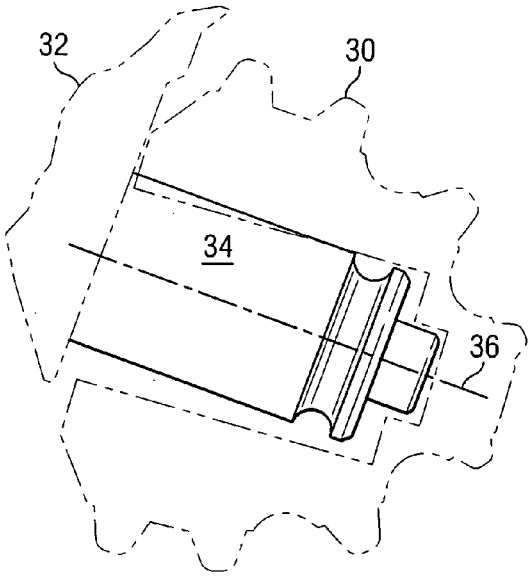
FIG. 9A shows a roller cone interacting with a bearing structure.

Now referring to FIGS. 8A, 8B, 9A and 9B that show the interaction between a roller cone and a bearing structure and forces acting thereon, when a roller cone experiences wobble. As shown in FIGS. 8A and 9A, roller cone assembly 30 extends from support arm 32 along desired axis of rotation 36. FIG. 8A illustrates an instance in which an uneven force is applied to roller cone assembly 30, where the force applied at the base of the roller cone 300 is greater than the force applied to at the middle 302 and the force applied at the end 304 of roller cone 30. This uneven force results in the cone assembly 30 having a wobble (such as transverse wobble 20 shown in FIG. 6) such that cone assembly does not rotate about desired axis of rotation 36. The wobble motion shown in FIG. 8A results in radial forces 306, 308, 310 and thrust load 312 acting on spindle 34. More specifically, at the moment of the transverse wobble shown in FIG. 8A, the lower portion of the rear portion of roller cone 30 acts upon the lower potion of the base of spindle 34, resulting in radial force 306. At the same moment, the upper portion of the top of the cone rotates downwardly upon spindle 34, resulting in downward radial load 308 and 310 acting at the top of spindle 34 and a thrusting load 312 acting on the lower face of spindle 34.

Figure 9B:
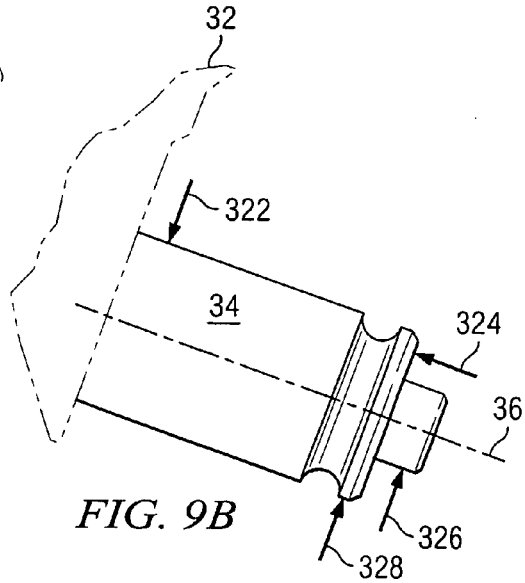
FIG. 9B shows the forces acting on the bearing structure.

FIG. 9A shows an additional instance of the wobble motion of roller cone 30 with respect to spindle 34, resulting in loads 322, 324, 326 and 328 acting on spindle 34 as shown in FIG. 9B. More specifically, at the moment of the transverse wobble shown in FIG. 9A, the lower portion of the front of roller cone 30 acts upon the upper potion of the end of spindle 34, resulting in radial loads 328 and 326. At the same moment, the upper portion of the base of roller cone 30 rotates downwardly upon the top portion of the base of spindle 34, resulting in downward radial load 322 acting on the top portion of the base of spindle 34 and also on thrusting load 324 (which may also be referred to as an axial or longitudinal load) acting on the upper face of spindle 34.

Figure 10A:
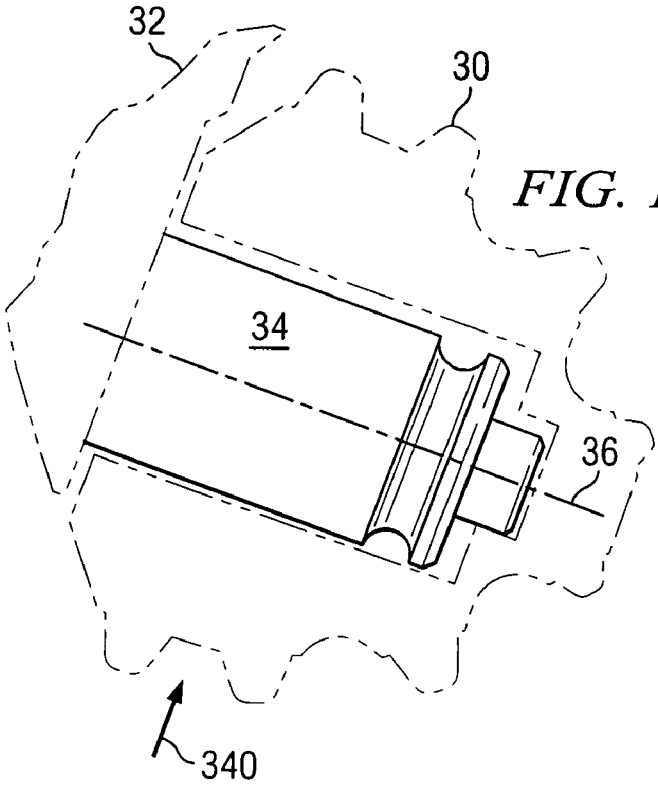
FIG. 10A shows a roller cone interacting with a bearing structure.
Figure 10B:
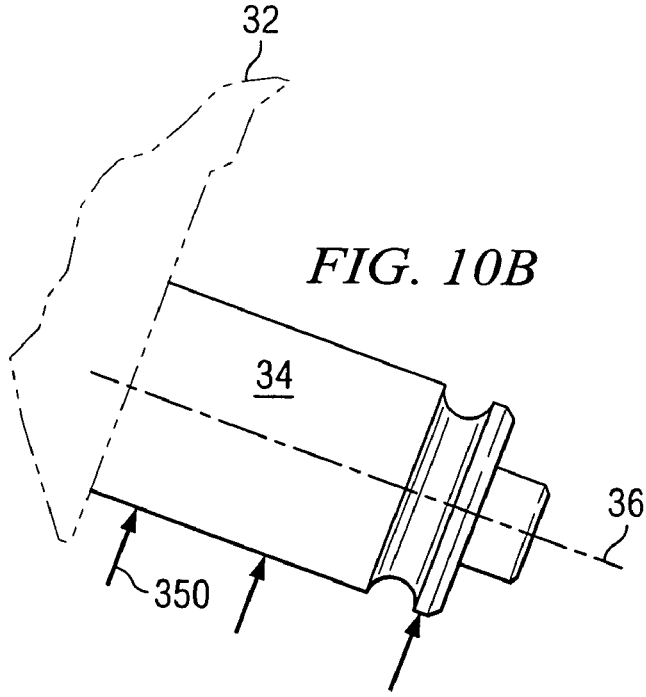
FIG. 10B shows the forces acting on the bearing structure.

FIGS. 10A and 10B show a preferred embodiment of roller cone assembly 30 rotating about spindle 34 and the forces resulting therefrom according to the present invention. As shown, force 340 acts upon a roller cone assembly 30 as it rotates about axis of rotation without significant wobble. Accordingly, resultant forces 350 act generally along the bottom portion of spindle 34 and in the direction of axis of rotation 36. The distribution of forces 350 represents a preferred and ideal condition and may preferably be achieved using the method and techniques of drill bit design taught herein.

In order to attain the desired loading shown in FIG. 10B, and as described in greater detail herein, the present invention includes a number of methods for designing drill bits to prevent cone wobble and facilitate a desired loading of the spindle.

One method includes first calculating the forces acting on all the teeth 60 of each cone 30 during each time step. Next, the total force acting on each cone 30 is calculated and transferred from the rotating cone coordinate system into the bearing coordinate system for each respective bearing. The contact zone (such as force points A 210 and B 212) between the bearing and the cone inner surface is then determined. A mechanics model (such as is shown in FIG. 22) is then used, based upon the contact zones established above. Next, the force distribution on each contact zone along the bearing is determined, as well as the average forces and maximal forces acting on each contact zone. As described previously, the contact zone and force distribution within the contact zone may be determined by finite element method.

The stresses experienced by the bearing elements (including rollers) are then calculated and compared with the design standard for each of the bearing elements. Next the cutting structure of each cone and/or the configuration of each bearing is modified and the calculations above are repeated until the calculated stress level for every bearing element meets its respective design standard.

Another design method includes first calculating the forces acting on teeth 60 of each cone 30 during each time step. Next the total force acting on each cone 30 is determined and then transferred from the cone coordinate system to the bearing coordinate system. Next, the location of the minimal bending moment along each respective bearing axis is determined. Each bearing configuration is provided such that the location of the minimal bending moment is located between the two major support points and preferably as close as possible to the midpoint between the two support points. The forces acting on all of the support points are then calculated.

The stresses on all of the bearing elements (including the rollers) are then calculated using finite element method. The bearing elements and bearing configuration for each respective bearing are then selected or designed. The bearing configuration may be modified and the forces and stresses may then be repeated in an interactive fashion, either for all of the bearings or for individual bearings.

For purposes of describing various features of the present invention approximately the same cutting elements 60, 60*a* and 60*b* will be used to illustrate various features of conventional roller cone drill bits and roller cone drill bits formed in accordance with teachings of the present invention. The cone assemblies shown in FIGS. 11-14 may have substantially the same cavity 43 and back face 42. Compacts 40 are not shown in sockets 44 of back face 42. Each cone assembly is shown with gauge row 74 having cutting element 60*a*. The other rows of cutting elements associated with the cone assemblies include cutting elements 60 and 60*b*. Cutting elements 60*a* and 60*b* may have smaller dimensions than cutting elements 60. For some applications the dimensions of all cutting elements associated within a cone assembly and roller cone drill bit incorporating teachings of the present invention may have substantially the same dimensions and configurations. Alternatively, some cone assemblies and associated roller cone bits may include cutting elements and cutting structures with substantial variation in both configuration and dimensions of associated cutting elements and cutting structures. The present invention is not limited to roller cone drill bits having cutting elements 60, 60*a* and 60*b*. Also, the present invention is not limited to cone assemblies and roller cone drill bits having cavity 48 and back face 42. Additionally, the determination of normal force axes shown in FIG. 11-14 may be determined using various methods. Examples of such methods are shown in copending patent application Ser. No. 10/919,990 filed Aug. 17, 2004 entitled, Roller Cone Drill Bits with Enhanced Drilling Stability and Extended Life of Associated Bearings and Seals and incorporate by reference herein.

Figure 11:
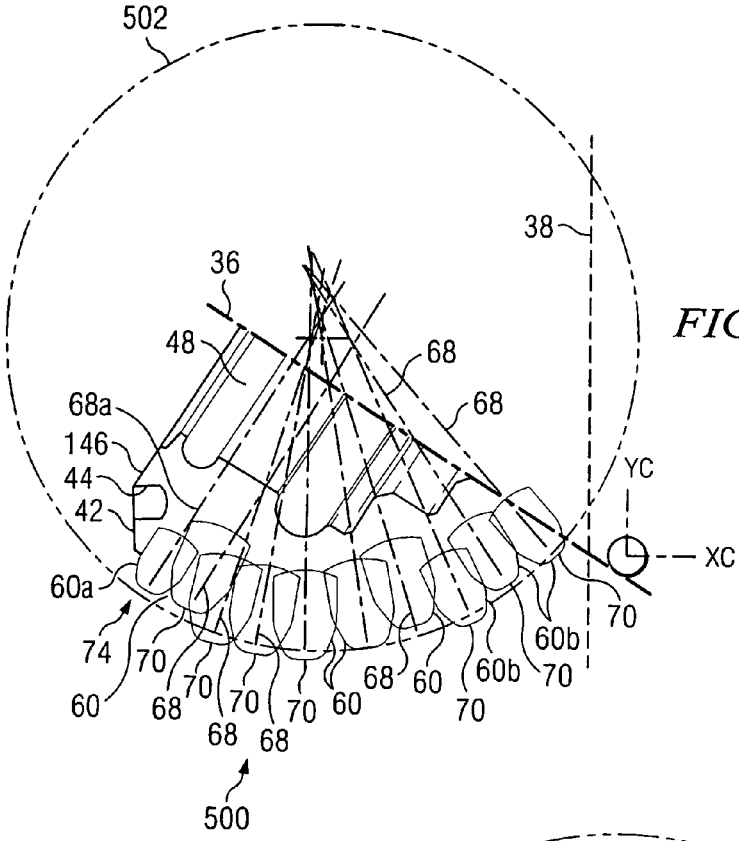
FIG. 11 shows a composite cone profile for a conventional roller cone drill bit.

FIG. 11 is a schematic drawing showing a composite cone profile for a conventional roller cone drill bit referred to below as "Bit A" 500 having three (3) assemblies with multiple cutting elements arranged in rows on each of the three cone assemblies. The crests of all cutting elements are shown projected onto a vertical plane passing through composite rotational axis 36 of the associated cone assemblies. Normal force axes 68 do not intersect or pass through a single point. Crest points 70 do not define a circle. Some of the crest points 70 extend outside circle 502 and other crest points 70 are located within circle 502.

Figure 12:
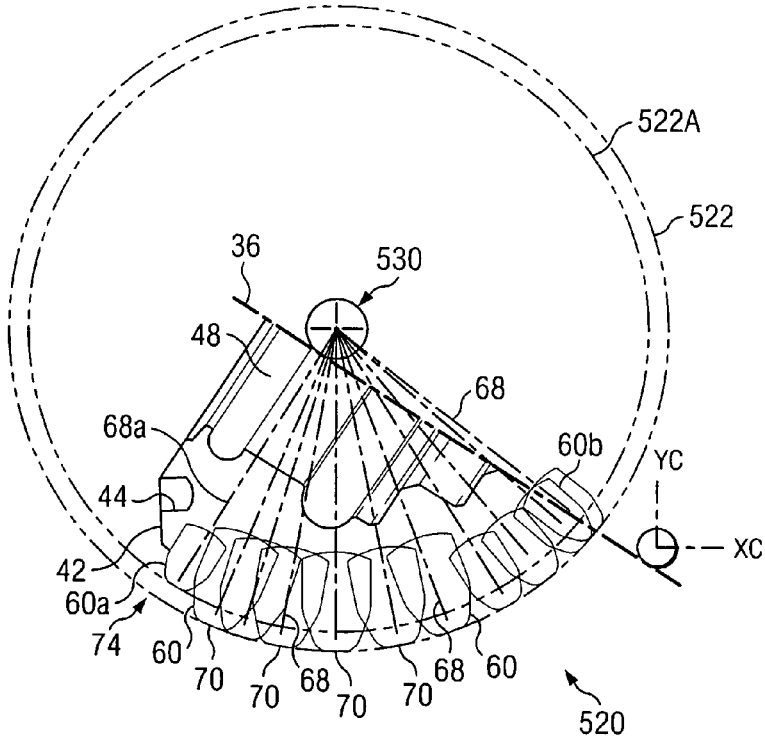
FIG. 12 is a schematic diagram showing a composite cone profile for a roller cone according to teachings of the present invention.

FIG. 12 is a schematic drawing showing composite cone profile 520 for cone assemblies for a roller cone drill bit referred to below as "Bit B" having cutting elements 60, 60*a* and 60*b* disposed on the three roller cones thereof in accordance with teachings of the present invention. For this embodiment normal force axes 68*a* associated with cutting elements 60*a* of gauge rows 74 and normal force axes 68 associated with cutting elements 60 and 60*b* preferably intersect with each other at force center 530. For this embodiment force center 530 may be offset from composite cone rotational axis 36. The amount of offset measured by $d_x$ and $d_y$ is preferably limited to the smallest amount possible.

Crest points 70 associated with cutting element 60 and 60*b* are preferably disposed along circle 522. The radius of circle 522 corresponds with the normal length of normal force axes 68. The length of normal force axis 68*a* may be less than normal force axes 68 which results in circle 522*a*. As shown in the present embodiment crest points 70 of cutting elements 60*a* in the gauge row 74 are preferably disposed on circle 522*a*. In alternated embodiments, crest points 70 of gauge row 74 may also be placed on circle 522*a*.

FIG. 13 is a schematic drawing showing composite cone profile 550 for cone assemblies for a roller cone drill bit referred to herein as Bit C having cutting elements 60, 60*a* and 60*b* disposed on the three roller cones thereof in accordance with teachings of the present invention. All normal force axes 68 associated with cutting elements 60 and 60*b* preferably intersect at force center 570 located on cone rotational axis 36. Normal force axes 68*a* associated with cutting elements 60*a* of gauge row 74 are offset from and does not intersect with force center 570 associated with normal force axes 68. As shown in this embodiment, normal force axis 68*a* is generally perpendicular to roller cone rotational axis 36. For this embodiment force center 570 may be very small with dimensions corresponding to a small sphere.

FIG. 14 is a schematic drawing showing composite cone profile 600 for three cone assemblies of a roller cone drill bit referred to below as "Bit D" having cutting elements 60, 60*a* and 60*b* disposed thereon in accordance with teachings of the present invention. For this embodiment, normal force axes 68*a* associated with cutting elements 60*a* of each gauge row 74 and normal force axes 68 associated with cutting elements 60*a* and 60*b* preferably intersect with each other at normal force center 610. For this embodiment force center 610 may be offset or skewed from composite cone rotational axis 36.

Crest points 70 of cutting elements 60 and 60*b* may be disposed on respective circles 602 and 602*b*. Crest point 70 associated with cutting element 60*a* of gauge rows 74 may be disposed on circle 602*a*. Each circle 602, 602*a* and 602*b* are preferably disposed concentric with each other relative to the center of force center 390.

Figure 15:
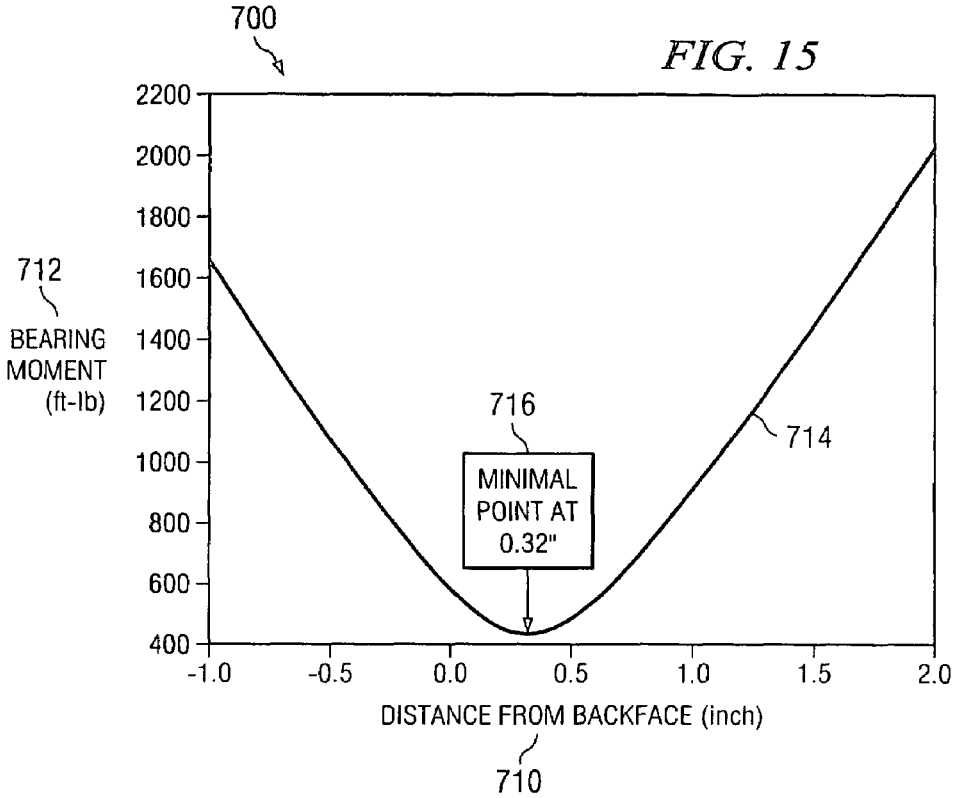
FIG. 15 is a graph showing bearing moment as a function of distance between a force simplified center and a back face.

Now referring to FIG. 15, chart 700 shows average bearing moment 712 as function of distance 710 from the force simplified center to cone back face. The resulting curve 714 is typical and shows a minimal moment center point 716. In this particular embodiment, minimal moment center point 716 is located at .32 inches from the back face, however, as described below the minimal moment center for any roller cone assembly will vary depending upon the cutting structure of the roller cone.

FIGS. 16A-D show the predicted bearing moments, measured in ft-lbs at points along the bearing axis for different bearings associated with the drill bits A-D describe in FIGS. 11-14.

Figure 16A:
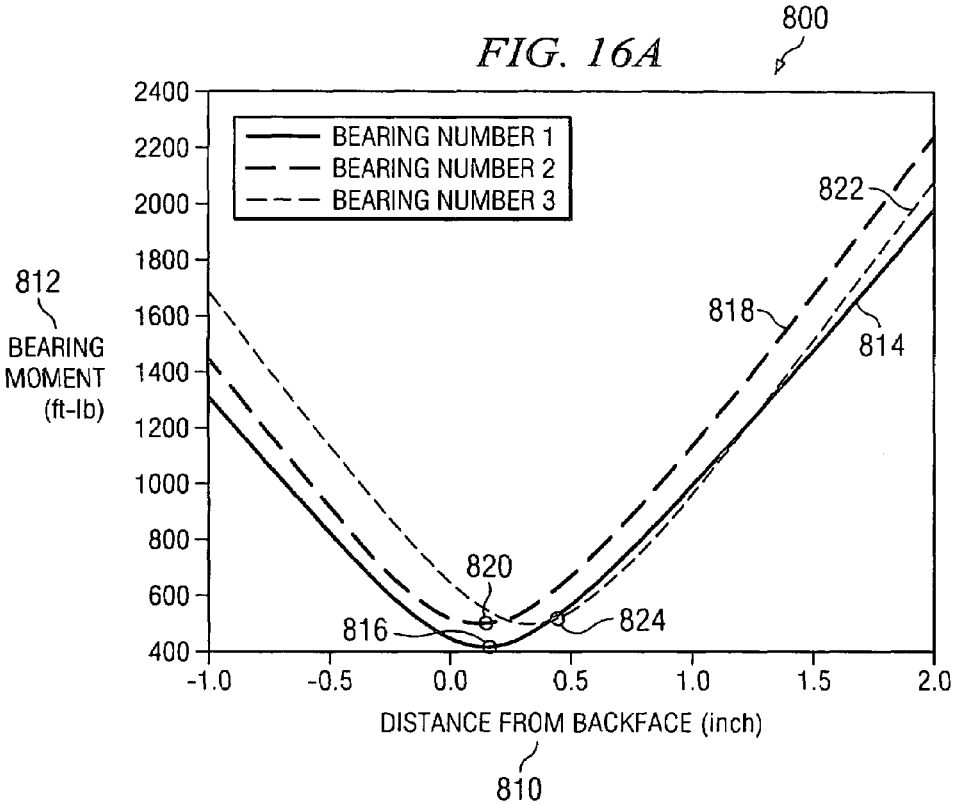
FIGS. 16A-D show predicted bearing bending moments for multiple bearings from the same bit as a function of distance from a back face.

Now referring to FIG. 16A, graph 800 shows a predicted bearing moment 812 of the three bearings of bit A (as shown in FIG. 11) as function of the distance from the back face 810. This results in curves 814, 818, and 822 corresponding to the first, second, and third bearings of bit A. As shown, curve 814 corresponding to the first bearing of bit A has a minimal moment point 816, curve 818 corresponding to the second bearing of bit A has a minimal moment point 820, and curve 820 corresponding to the third bearing of bit A has a minimal moment point 824. Accordingly, each bearing on bit A has its own distinct minimal moment point (points 816, 820, and 824, respectively). This fact demonstrates that using the same bearing structure for all three cones of a bit is typically not an optimal solution.

Figure 16B:
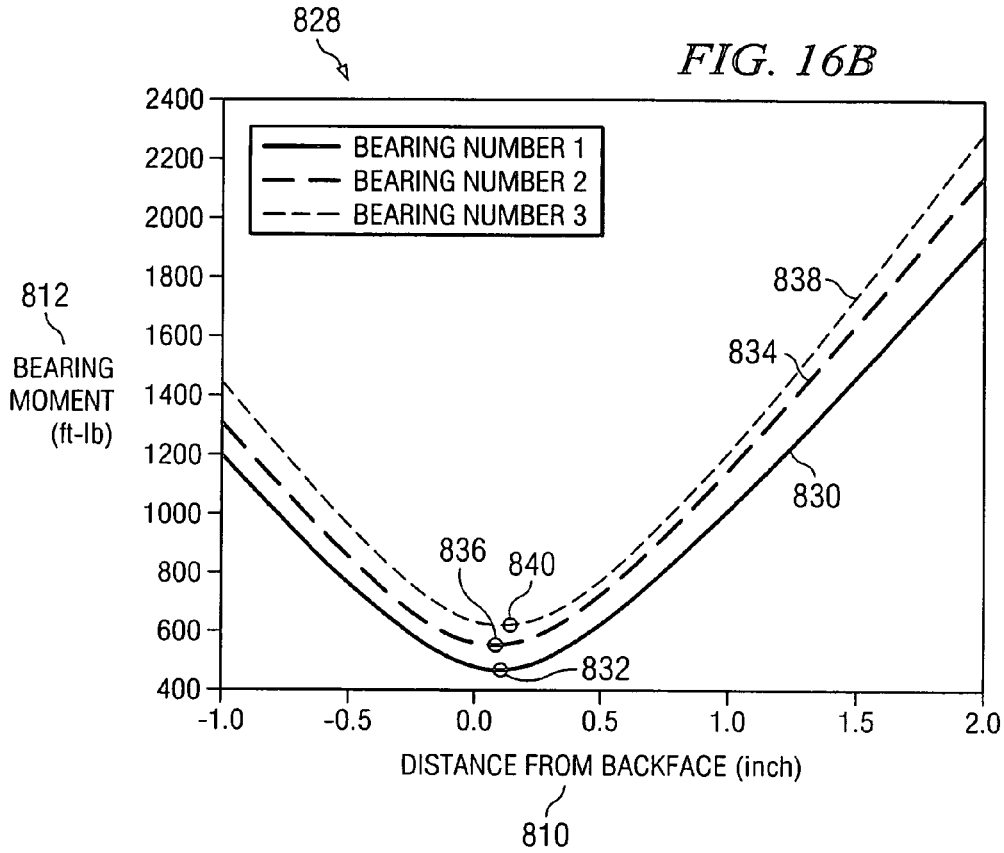

Now referring to FIG. 16B, graphical representation 828 shows a predicted bearing moment 812 of the three bearings of bit B (as shown in FIG. 12) as a function of the distance from the back face 810. This results in curves 830, 834, and 838 corresponding to the first, second, and third bearings of bit B. As shown, curve 830 corresponding to the first bearing of bit B has a minimal moment point 832, curve 834 corresponding to the second bearing of bit B has a minimal moment point 836, and curve 838 corresponding to the third bearing of bit B has a minimal moment point 840. Accordingly, each bearing on bit B has its own distinct minimal moment point (points 832, 836, and 840, respectively). As shown, minimal moment points 832, 836, and 840 of Bit B are different from minimal moment points 816, 820, and 824 of bit A (as shown in FIG. 16A).

Figure 16C:
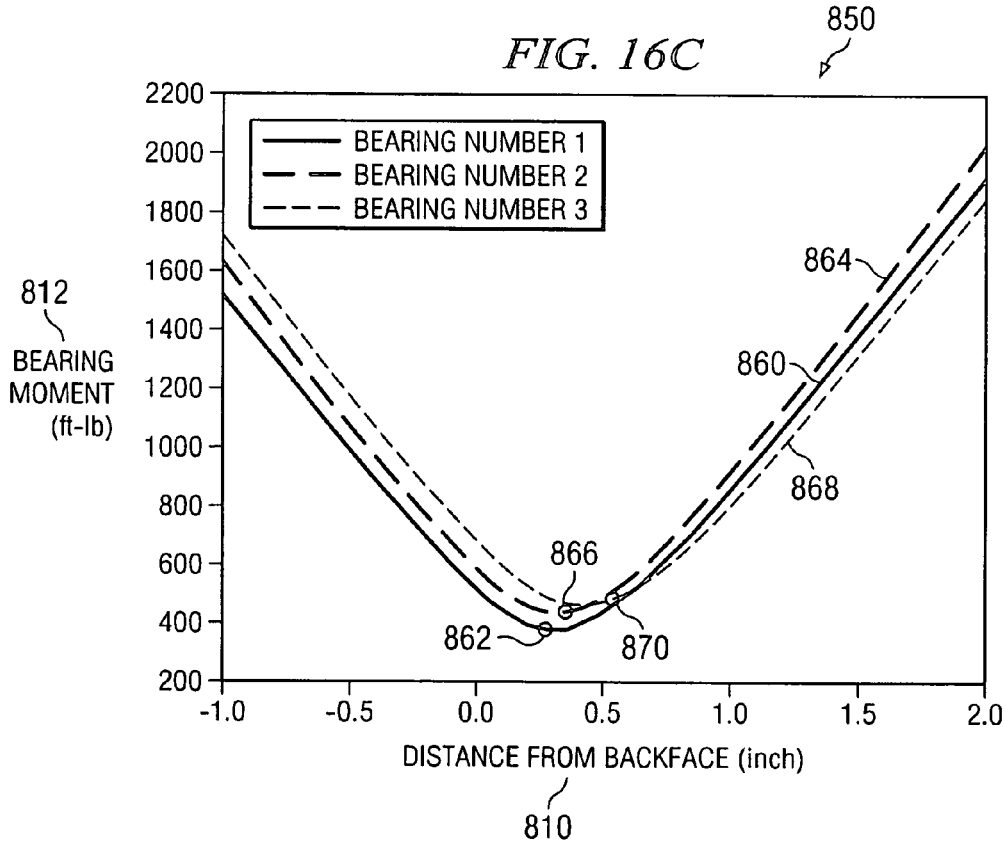

Now referring to FIG. 16C, graphical representation 850 shows a the predicted bearing moment 812 of the three bearings of bit C (as shown in FIG. 13) as a function of the distance from the back face 810. This results in curves 860, 864, and 868 corresponding to the first, second, and third bearings of bit C. As shown, curve 860 corresponding to the first bearing of bit A has a minimal moment point 862, curve 864 corresponding to the second bearing of bit C has a minimal moment point 866, and curve 868 corresponding to the third bearing of bit C has a minimal moment point 870. Accordingly, each bearing on bit C has its own distinct minimal moment point (points 862, 866, and 870, respectively). In this embodiment the minimal moment points of all three bearings are shifted away from the cone back face. In other words, the change of cone profile from bit B to bit C leads to the minimal moments points being closer to the bearing center.

Figure 16D:
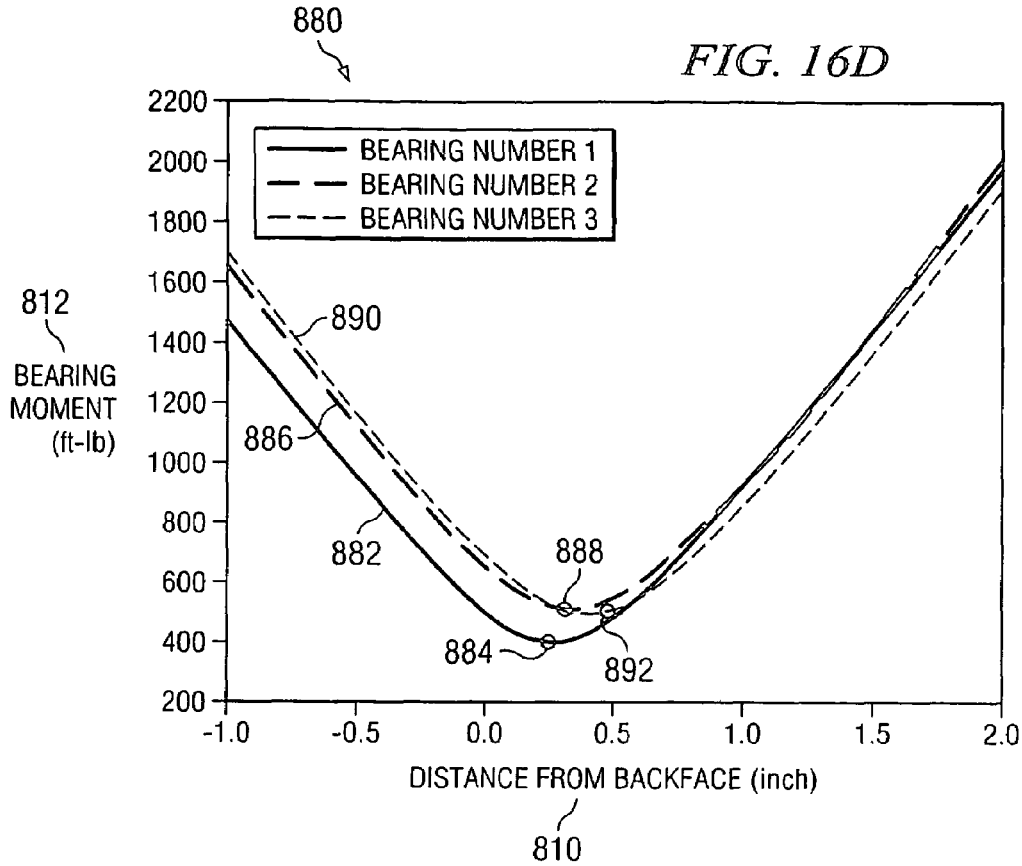

Now referring to FIG. 16D, graphical representation 880 shows the predicted bearing moment 812 of the three bearings of bit D (as shown in FIG. 14) as a function of the distance from the back face 810. This results in curves 882, 886, and 890 corresponding to the first, second, and third bearings of bit D. As shown, curve 882 corresponding to the first bearing of bit D has a minimal moment point 884, curve 886 corresponding to the second bearing of bit D has a minimal moment point 888, and curve 890 corresponding to the third bearing of bit D has a minimal moment point 882. Accordingly, each bearing on bit D has its own distinct minimal moment point (points 884, 888, and 892, respectively). Similar to Bit C, the minimal moment points of all three bearings of this embodiment are shifted away from cone back face and closer to the bearing centers.

Figure 17A:
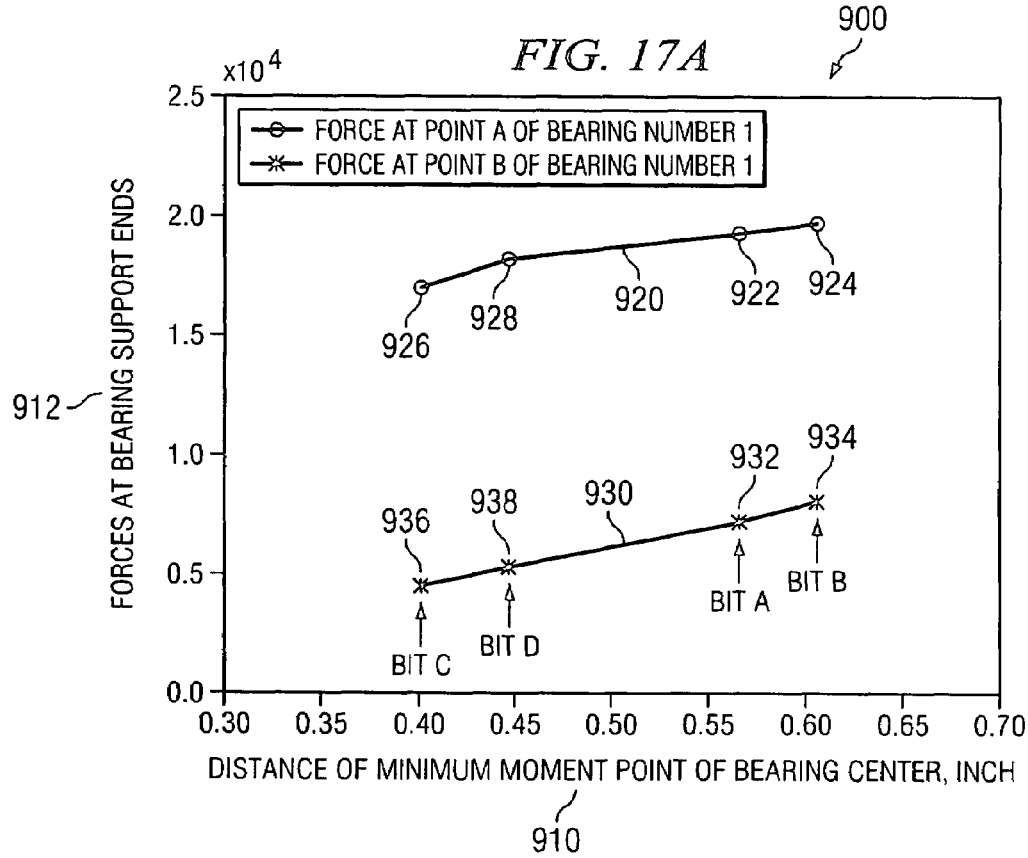
FIGS. 17A-C show the forecast of estimated bearing end loads on corresponding bearings of different drill bits.
Figure 17B:
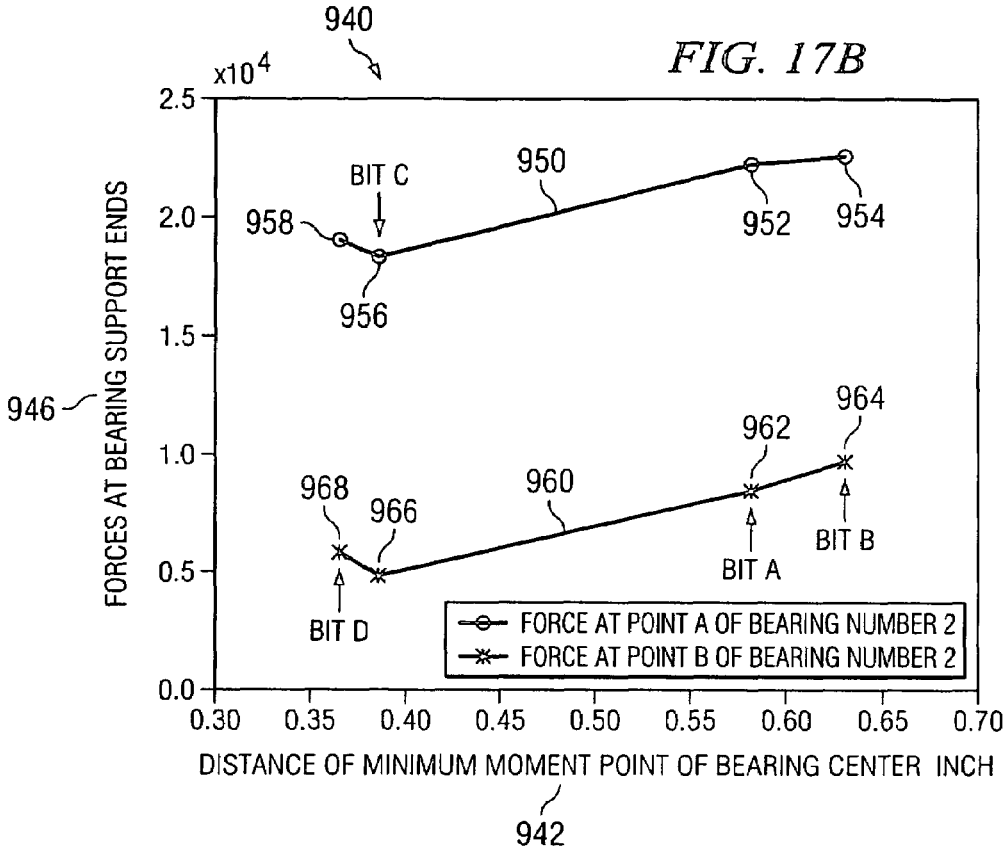
Figure 17C:
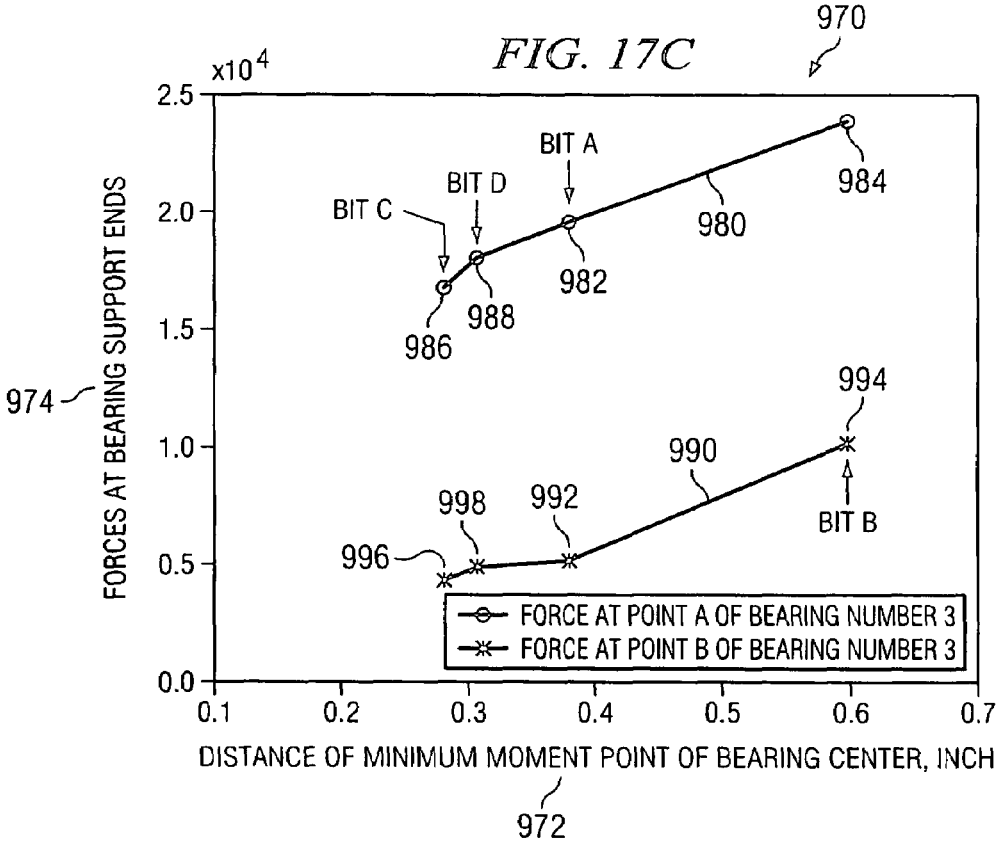

Now referring to FIGS. 17A-C, graphical representations showing the forces acting on bearing ends A and B for each bearing are shown for drill bits A, B, C, and D as shown in FIGS. 11-14. FIGS. 17A-C indicate that bit C is optimally designed to reduce the amount of force and moment. In the present embodiments, bits A, B, C, and D, the prediction of bearing end loads is based on the normal forces acting on the roller cone and, in the present exemplary embodiment, do not include any tangential force or other forces acting on the cutting structure.

FIG. 17A shows a graph 900 of the estimated bearing end load 912 as a function of distance from the minimal momeht point to bearing center 910 for the first bearing of bits A-D. The load or force at point A of the first bearing 920 is shown, as well as the load or force at point B for each first bearing of Bits A, B, C & D. As shown, bit A is predicted to have the bearing loads indicated at points 922 and 932; bit B is predicted to have the bearing loads indicated at points 924 and 934; bit C is predicted to have the bearing loads indicated at points 926 and 936; and bit D is predicted to have the forces indicated at points 928 and 938. As shown, the design of bit C results in the lowest estimated loads acting at the bearing ends A and B.

FIG. 17B shows a graph 940 of the estimated bearing end load 942 as a function of distance from minimal moment point to bearing center 946 for the first bearing of bits A-D. The load or force at point A of the first bearing 950 is shown, as well as the load or force at point B 960 for each second bearing of Bits A, B, C & D. As shown, bit A is predicted to have the bearing loads indicated at points 952 and 962; bit B is predicted to have the bearing loads indicated at points 954 and 964; bit C is predicted to have the bearing loads indicated at points 956 and 966; and bit D is predicted to have the forces indicated at points 958 and 968. As shown, the design of bit C results in the lowest estimated loads acting at the bearing ends A and B of the second bearing.

FIG. 17C shows a graph 970 of the estimated bearing end load 972 as a function of distance from minimal moment point to bearing center 974 for the third bearing of bits A-D. The load or force at point A of the third bearing 980 is shown, as well as the load or force at point B 990 for each second bearing of Bits A, B, C & D. As shown, bit A is predicted to have the bearing loads indicated at points 982 and 992; bit B is predicted to have the bearing loads indicated at points 984 and 994; bit C is predicted to have the bearing loads indicated at points 986 and 996; and bit D is predicted to have the forces indicated at points 988 and 998. As shown, the design of bit C results in the lowest estimated loads acting at the bearing ends A and B of the third bit.

Figure 18:
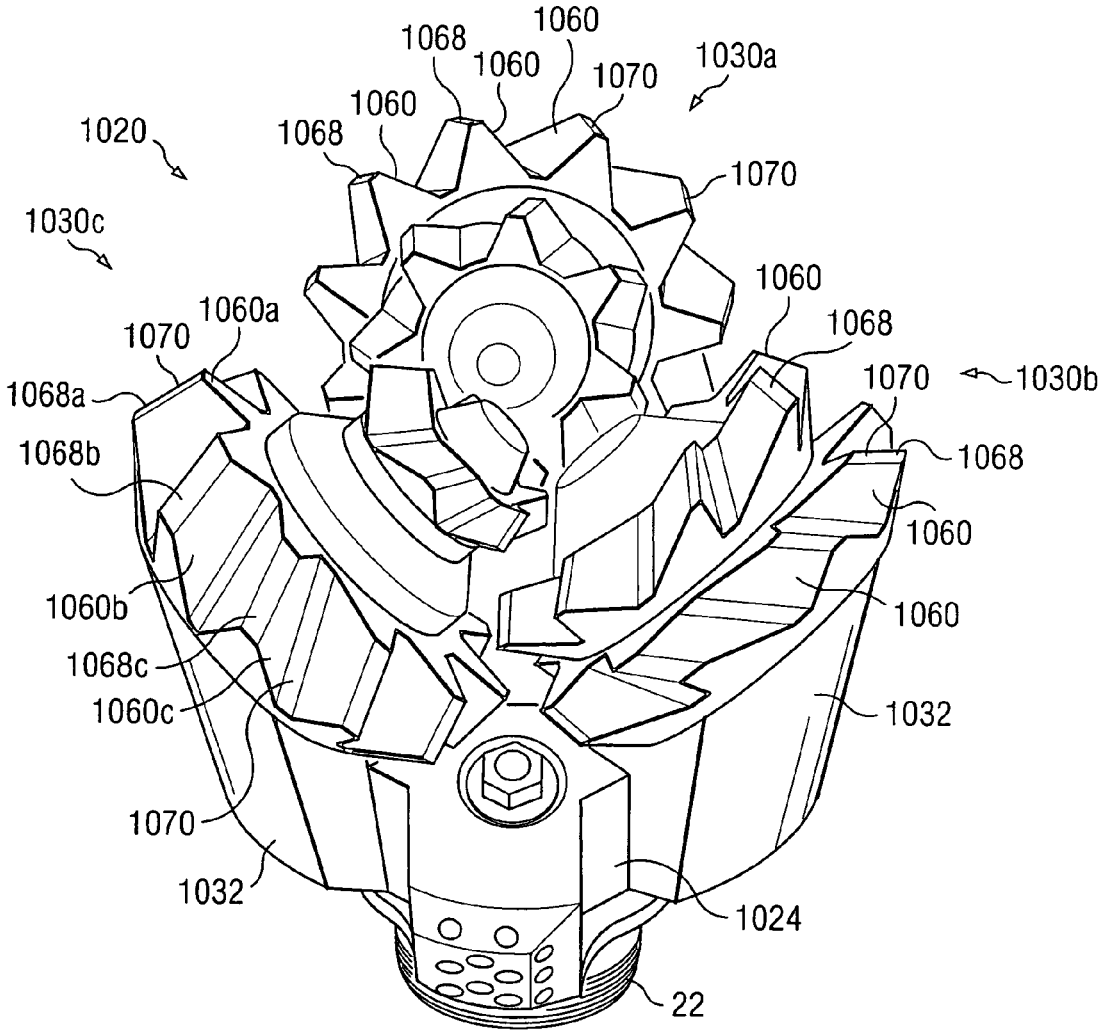
FIG. 18 shows a roller cone bit having milled teeth according to teachings of the present invention.

FIG. 18 is a schematic drawing showing roller cone drill bit 1020 having bit body 1024 with tapered, externally threaded portion 22. Bit body 1024 preferably includes a passageway (not expressly shown) to communicate drilling mud or other fluids from the well surface through a drill string to attached drill bit 1020. Bit body preferably includes three support arms where each support arm preferably includes a respective shaft or spindle (not expressly shown). Cone assemblies 1030*a*, 1030*b* and 1030*c* may be attached to respective spindles.

Cutting elements 1060 with respective crests 1068 and crest points 1070 may be formed on each cone assembly 1030*a*, 1030*b* and 1030*c* using milling techniques. Cutting elements 1060 may sometimes be referred to as "milled teeth". Cutting elements 1060 may be formed such that normal force axes intersect at a desired force center and that bearing centers are located proximate minimal moment centers as previously described.

As described above, the intersection of normal force axes 68 at a small force center or single point on cone rotational axis 36 substantially reduces or eliminates the detrimental effects of moments $M_X$ and moments $M_Y$ reducing the likelihood of wobble of associated cone assemblies 30*a*, 30*b* and 30*c*. Reducing cone wobble may increase the life of associated bearings and seals.

In some embodiments, normal force axes 68 may preferably intersect a force center (such as is shown in FIGS. 12, 13 and 14), where the force center is generally located at the center point of the bearing assembly. In alternate embodiments that include only a single bearing, normal force axes 68 may preferably intersect force center 90 where force center 90 generally corresponds with the bearing center. In embodiments that incorporate additional bearing components within the bearing assembly, normal force axes 68 may preferably intersect at a force center that generally corresponds with the center of the bearing assembly One advantage of the present invention is that bearing wear may be minimized because bearing wear is directly related to forces acting on the bearing surface. Additionally, cone wobble motion is minimized by locating the bearing center and minimal moment center close to each other, thereby better balancing the roller cone with the bearing surfaces. Additionally, reducing cone wobble also may reduce seal wear, which is often accelerated by cone wobble motion. Additionally, the teaching of the present invention reduce the probability of cone loss, because cone loss if often caused by heavy wear on the bearing surface.

Now referring to FIG. 19, a flow diagram 1100 showing a method according to the present invention is shown. The method begins 1102 by first forming a bit body 1104. This typically includes forming a bit body with at least a first support arm, a second support arm, and a third support arm, with each support arm having a spindle extending therefrom. Next, a first cone assembly with a first cutting structure is provided 1106, a second cone assembly having a second cutting structure 1108 is provided and a third cone assembly having a third cutting structure is provided 1110.

The minimal moment center of each respective cone assembly is determined 112, 114, 116 based upon the cutting structure of each cone assembly. In some embodiments, this involves determining the first minimal moment center based upon the insert profile angle of each cutting element of each respective cutting structure. In other embodiments, calculating the minimal moment centers of each respective cone assembly involves determining each respective minimal moment center based upon the cone profile of each respective cutting structure.

Next, the respective bearing assemblies are selected or designed such that the bearing center of each bearing is disposed proximate each respective minimal moment center 1118, 1120 and 1122 along each respective axis of rotation. Next, the bearing design or selection may be changed 1123, 1124 and 1125 in order for each respective bearing center to be within a desired proximity to its respective minimal moment center. If a respective bearing center is not within a desired proximity to its corresponding minimal moment center, the bearing selection and/or design is modified and the method revisits steps 1118, 1120 or 1122, as appropriate. In the event that the selected bearing center is satisfactorily proximate to a respective minimal moment center, the method then ends 1126, at least with respect to that respective bearing assembly.

Figure 20:
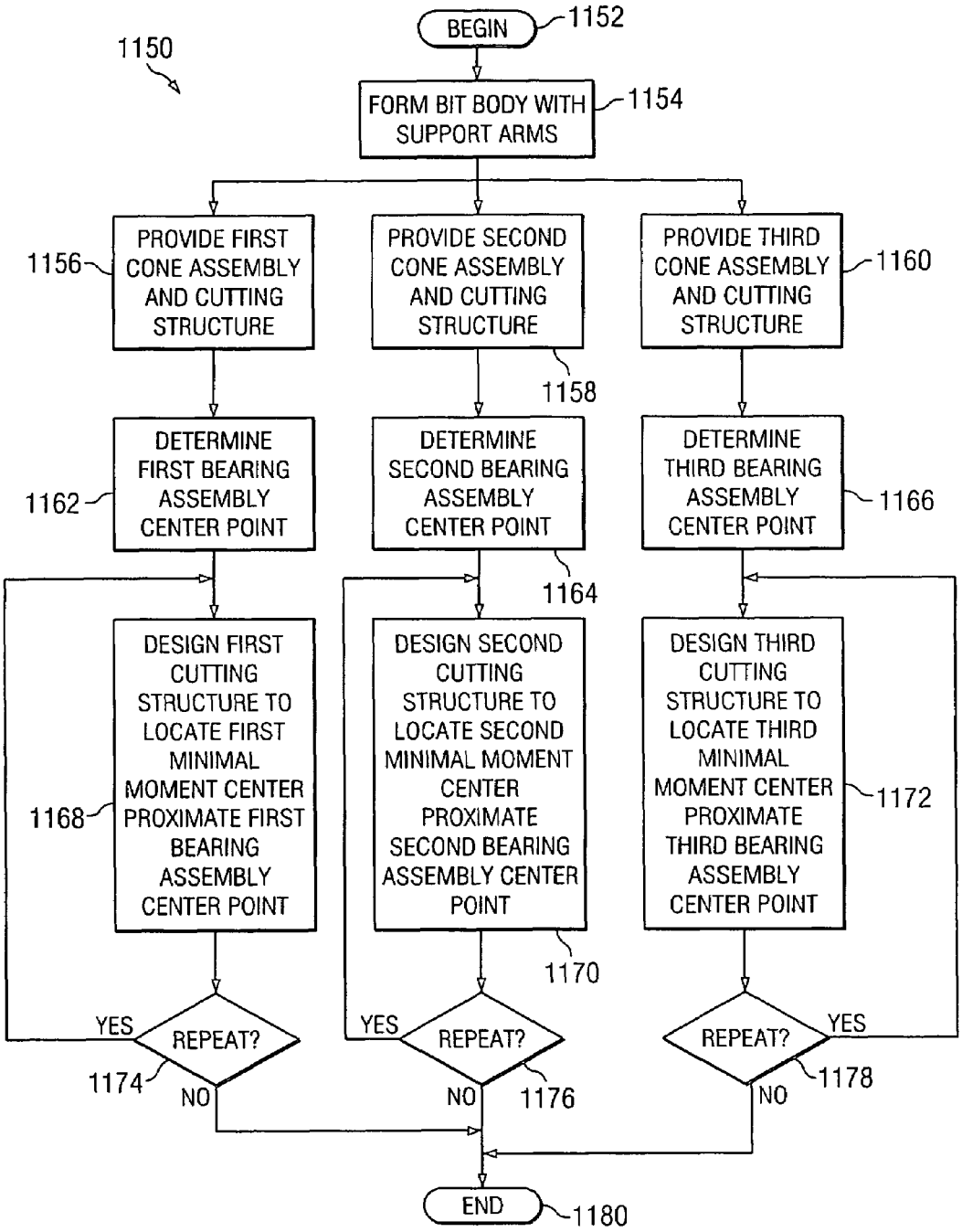
FIG. 20 is a flow diagram showing a method of forming a drill bit according to teachings of the present invention.

Now referring to FIG. 20, a flow diagram 1150 showing a method according to the present invention is shown. The method begins 1152 by first forming a bit body 1154. This typically includes forming a bit body with at least a first support arm, a second support arm, and a third support arm, with each support arm having a spindle extending therefrom. Next, a first cone assembly with a first cutting structure is provided 1156, a second cone assembly having a second cutting structure 1158 is provided and a third cone assembly having a third cutting structure is provided 1160.

Next, the center point for the first bearing is determined 1162. The center point for the second bearing may also be determined 1164 as well as the center point for the third bearing assembly 1166. Following the determination of the first bearing center point 1162, the cutting structure of the first cone assembly may be designed such that the first cone assembly has a minimal moment point proximate the first bearing center point 1168. Following the determination of the second bearing center point 1164, the cutting structure of the second cone assembly may be designed such that the second cone assembly has a minimal moment point proximate the second first bearing center point 1170. Following the determination of the third bearing center point 1166, the cutting structure of the third cone assembly may be designed such that the third cone assembly has a minimal moment point proximate the third bearing center point 1172.

After designing or modifying the first cutting structure 1168, the method may then determine whether further modification of the first cutting structure is desired 1174. In the event that the first minimal moment center and the first bearing assembly center point are not sufficiently proximate, the cutting structure may be further modified. In the event that the first minimal moment center and the first bearing assembly center point are sufficiently proximate, the method may end 1180 (or may then proceed to the design of second cone assembly or the third cone assembly). Similarly, the after designing the second and third cutting structures (1170 and 1172, respectively) the method then proceed to determine whether additional modifications to second and third cutting structures are desired at steps 1176 and 1178, respectively. In alternate embodiments, following the determination that further modification is required (such as in steps 1174, 1176 or 1178, the method may additionally proceed to modify the design or selection of the associated bearing assembly.

In some embodiments, the adjustment of the design of the roller cone cutting structure and the bearing assembly may take place simultaneously. In other embodiments, the adjustment of the design of the roller cone cutting structure and the bearing assembly preferably takes place iteratively.

Figure 21:
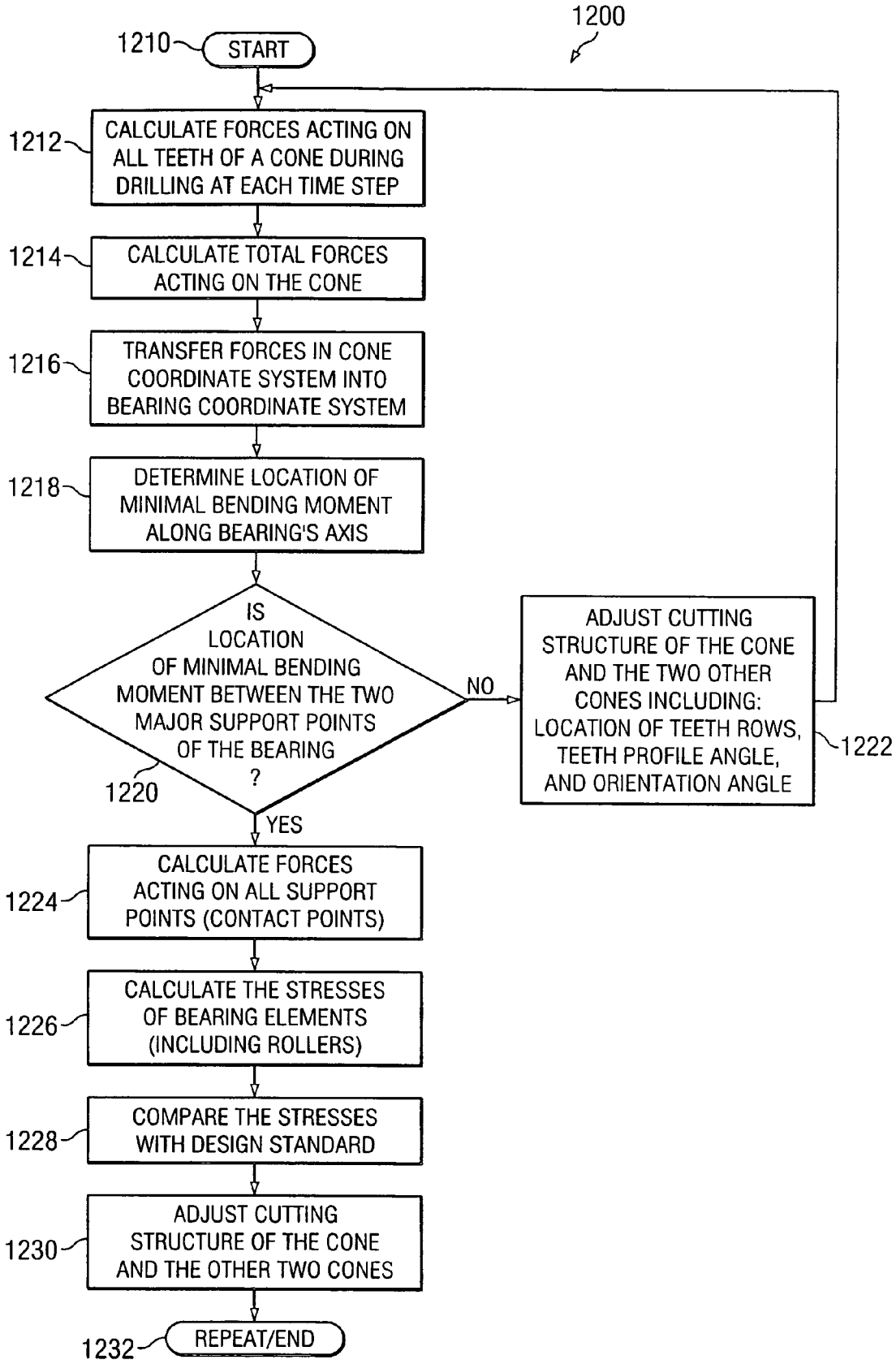
FIG. 21 is a flow diagram showing a method for adjusting the cutting structure of a roller cone where a bearing configuration is pre-designed.

Now referring to FIG. 21, flow diagram 1200 shows an improved method for designing a bearing structure by selectively designing the roller cone cutting structure. In preferred embodiments, the bearings utilized according to this method may be pre-designed and fixed. In such embodiments, the same bearing design may be used for each roller cone assembly or each roller cone assembly may utilize a different bearing design. The method begins 1210, and the forces acting on all the cutting elements of a cone at each time step 1212 are calculated. Next the total force acting on each cone is calculated at step 1214 and then transferred from the cone coordinate system to the bearing coordinate system 1216. Next, the bending moment along the bearing axis is calculated to determine the location of the minimal moment point (which may also be referred to as the minimum moment center) 1218. In the following step it is determined whether the minimal moment point is located between the two major support points of the bearing 1220.

If the minimal moment point is not located between the major support points, the design of the cutting structure is modified 1222. The modification of the cutting structure may include adjusting the location of cutting element rows, cutting element profile angle and orientation angle. After the modification of the cutting structure design, the previous steps are repeated in order to determine whether the minimal moment center is located in a desired position (between the two major support points of the bearing).

If the minimal moment point is located between the major support points, the force acting on each bearing contact point is calculated 1224. This calculated force is then used to calculate the stress acting on each bearing element (including rollers, where suitable) 1226. The calculated stress for each bearing element is then compared with the design stress for each bearing element 1228. Additional design changes may then be made to the cutting structure of the cone or to the other two cones 1230. The above steps may then be repeated for another cone or, if the design of the cones of the bit is satisfactory, the method ends 1232.

Figure 22A:
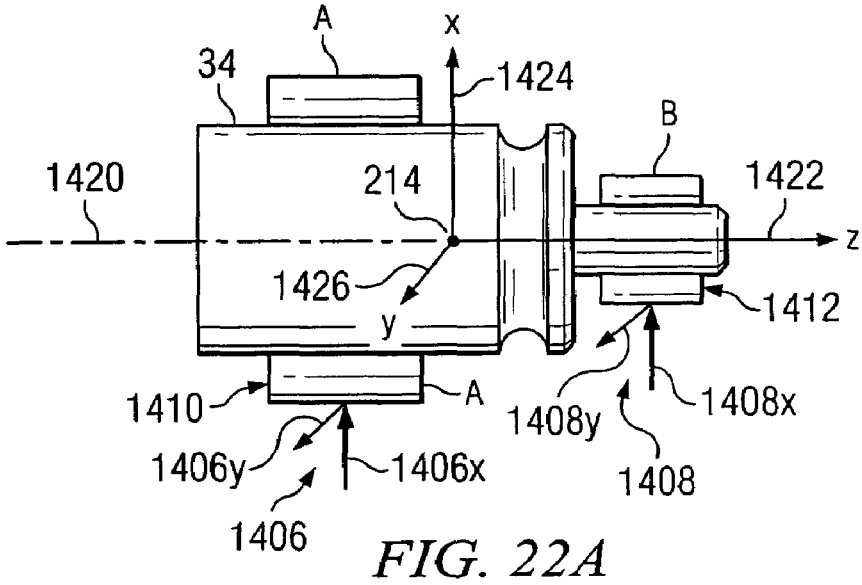
FIG. 22A-22E depicts a bearing force mechanics model and coordinate system for calculating force as a function of drilling time.

Now referring to FIGS. 22A-22E that demonstrate portions of a mechanics model for carrying out some of the steps of the present invention. FIG. 22A is a side view of spindle 34 that shows force 1406 acting at contact area A 1410 and force 1408 acting at contact area B. Spindle 34 also includes bearing center point 214 along bearing axis 1420. Bearing center point 214 is also the center for the bearing coordinate system where the Z-axis 1422 coincides with bearing axis 1420. Further, as shown in the present embodiment, force 1406 is shown separated into force $\mathbf{1406}_x$ acting in the direction of x-axis 1424 and force $\mathbf{1406}_y$ acting in the direction of y-axis 1426.

Figure 22B:
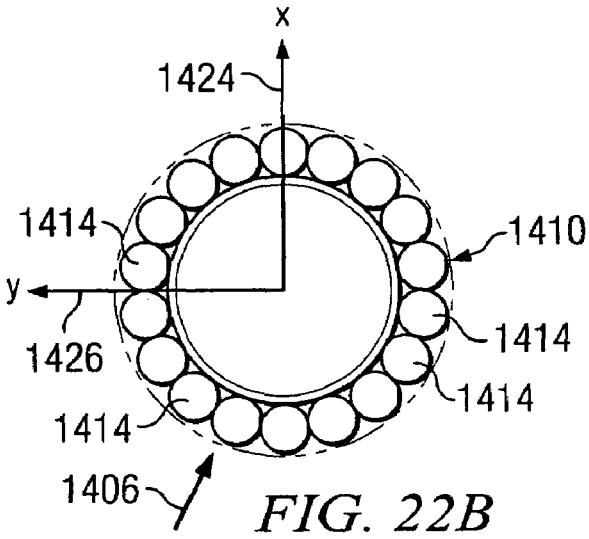

FIG. 22B shows a cross sectional view of contact area A 1410, including a cross sectional view of bearing elements 1414. In this embodiment bearing elements 1414 comprise rollers. In alternate embodiments bearing elements 1414 may be journal bearing surfaces or any other suitable bearing element. Force 1406 represents a simplified force based on a plurality of predicted radial forces acting circumferentially around bearing contact area A.

Figure 22C:
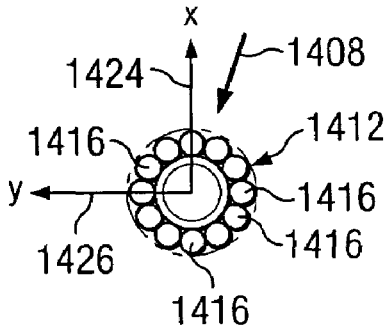

FIG. 22C shows a cross sectional view of contact area B 1412 including a cross sectional view of bearing elements 1414. In this embodiment bearing elements 1416 comprise rollers. In alternate embodiments bearing elements 1414 may be journal bearing surfaces or any other suitable bearing element. Force 1408 represents a simplified force based upon a plurality of predicted radial forces acting circumferentially around being contact arm A.

Figure 22D:
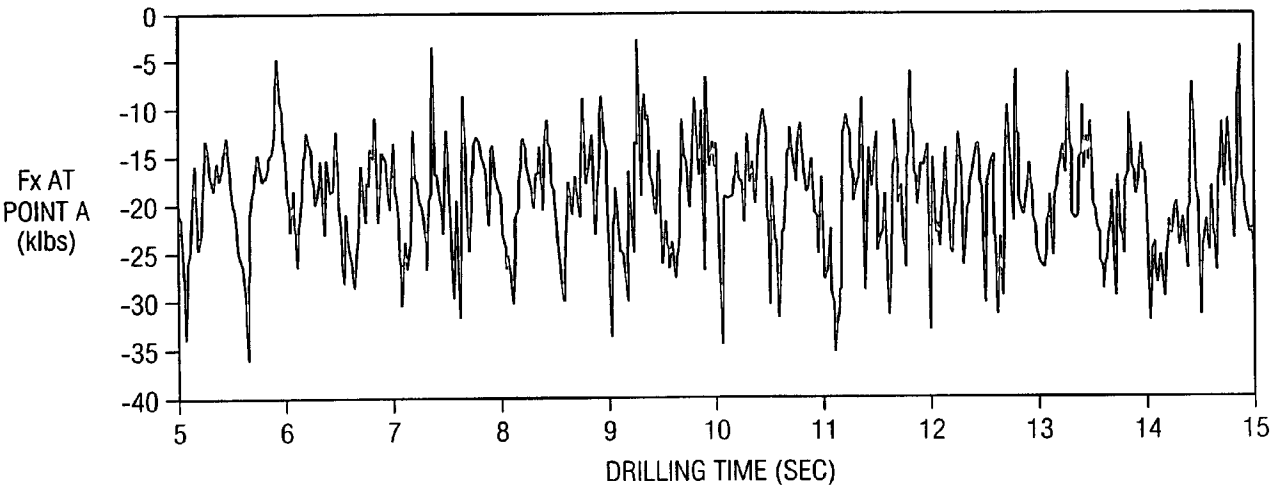

Now referring to FIG. 22D, a graphical representation 1440 of force 1406 acting at contact area A 1410 as a function of time during drilling is shown. In the present embodiment, the predicted force acting along x-axis 1424 is at a selected time step. A corresponding graph may also be provided for showing the magnitude of forces acting in the direction of y-axis 1426.

Figure 22E:
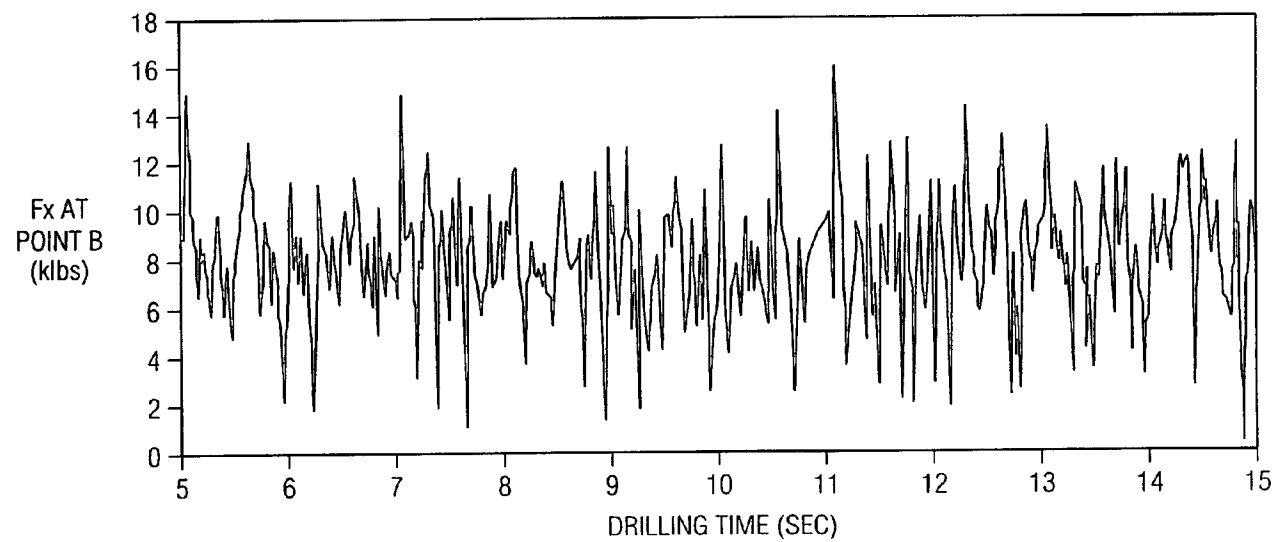

Now referring to FIG. 22E, a graphical representation 1450 of force 1408 acting at on contact area B 1412 as a function of time during drilling is shown. In the present embodiment, the predicted force acting along x-axis 1424 is shown for a period of time and at a selected time step. A corresponding graph may also be provided for showing the forces acting on contact area B 1412 in the direction of y-axis 1426.

Figure 23:
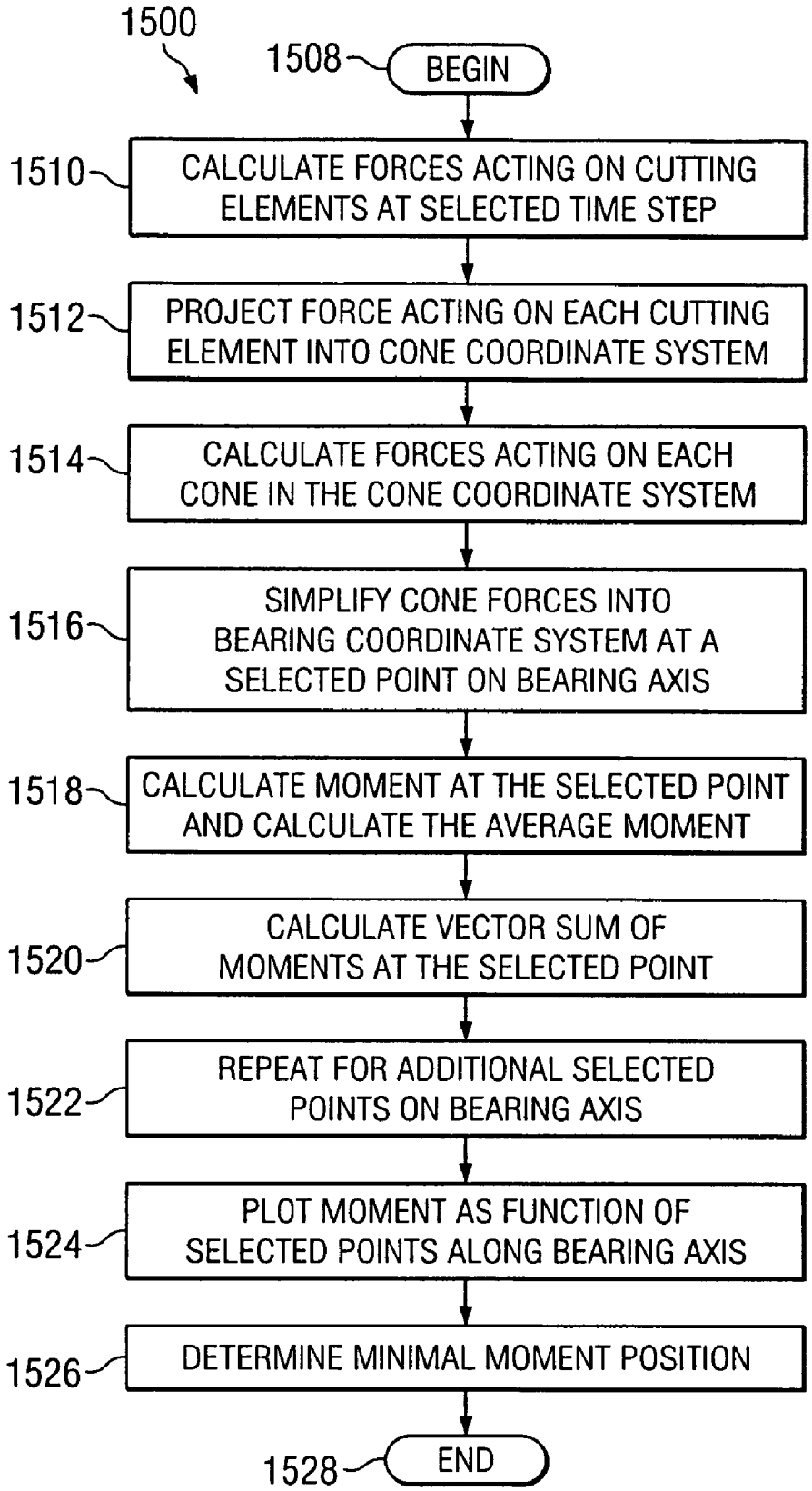
FIG. 23 is a flow diagram showing a method for determining a minimal moment center.

Now referring to FIG. 23, flow diagram 1500 shows a method for determining a minimal moment center. The method begins 1508 by calculating forces acting on cutting elements of a roller cone at a selected time step 1510. Next the force acting on each cutting element is projected into the cone coordinate system 1512. In the following step forces acting on each cone are calculated in the cone coordinate system 1514. Next, the bearing axis the forces acting on the cone are simplified into a bearing coordinate system centered at a selected point 1516.

The moment and average moment at the selected point are then calculated 1518 using the bearing coordinate system. The vector sum of the moments at the selected point are then calculated 1520. Next, an additional point (or points) along the bearing axis is selected and the cone forces are simplified into a bearing coordinate system centered at the newly selected point (or points) and calculating the moment at that selected point 1522. In other words, step 1522 may include repeating steps 1516, 1518 and 1520 for other points along the bearing axis. The moment is plotted as a function of the selected points along the bearing axis 1524. Next the minimal moment position along the bearing axis is determined using the plot data 1526.

Figure 24:
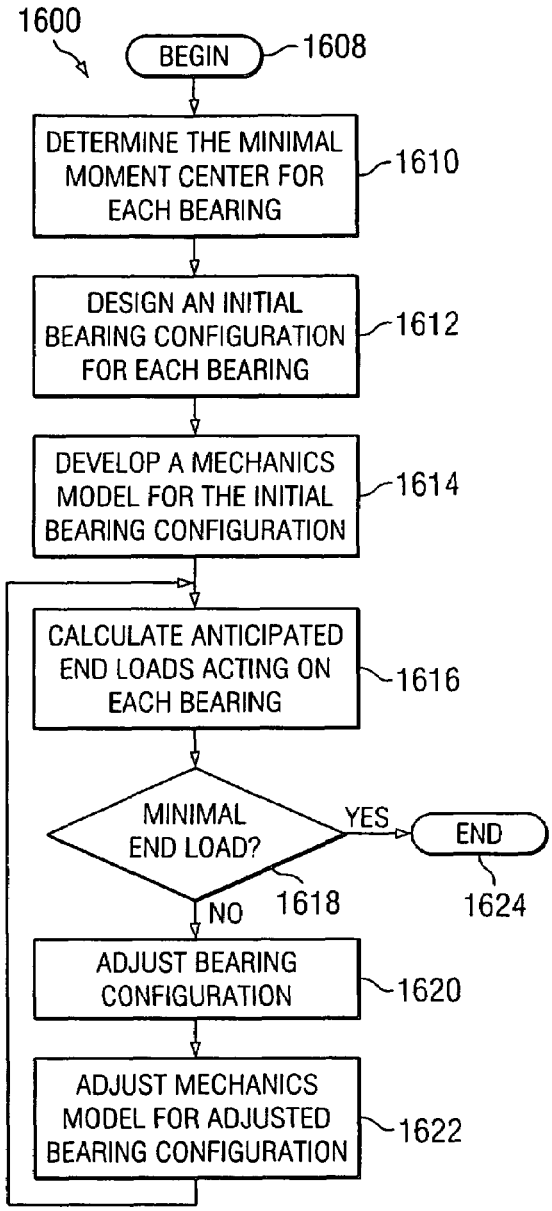
FIG. 24 shows a method of designing a bearing structure configuration according to teachings of the present invention.

Now referring to FIG. 24, flow diagram 1600 shows a method of designing a bearing structure configuration. The method begins at 1608 by first determining the minimal moment center of a bearing of a roller cone within a roller cone drill bit 1610. Next an initial bearing configuration is designed for each bearing 1612. Next, a mechanics model (as shown in FIGS. 22A-E, for example) is developed for the initial bearing configuration 1614. The method proceeds by calculating the anticipated end loads acting on each bearing 1616.

In the next step, a determination is made as to whether the end loads have been substantially minimized 1618. In the event that the end loads have been minimized or substantially minimized, the method is complete 1624. However, in the event that the end loads have not been minimized, the method proceeds by adjusting or resigning the bearing configuration or bearing structure 1620. In some embodiments this may include redesigning the physical structure of the bearing. In alternate embodiments this may include replacing the initial bearing type with a different bearing type or model. The mechanics model is then adjusted to allow for the adjusted bearing configuration 1622 and the method then proceeds to step 1616 and calculates the anticipated end loads acting on each bearing.

Figure 25:
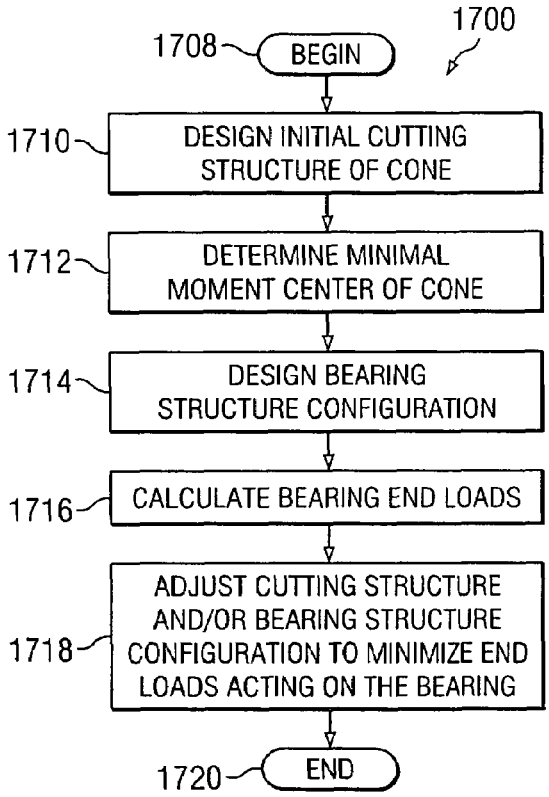
FIG. 25 also shows a method of designing a bearing structure configuration according to teachings of the present invention.

Now referring to FIG. 25, a flow diagram 1700 shows a method for designing a bearing structure configuration. The method begins 1708 by first designing an initial cutting structure of a cone for a roller cone drill bit 1720. Next a minimal moment center of the cone is determined 1712. The bearing structure configuration is selected or designed 1714 and the end loads acting on the bearing are calculated 1716. The cutting structure and/or the bearing structure configuration may then be adjusted, reselected or redesigned to minimize the end loads acting on the bearing 1718.

Although the present invention and its advantages have been described in detail, it should be understood that various changes, substitutions and alternations can be made herein without departing from the spirit and scope of the invention as defined by the following claims.

What is claimed is:

1. A roller cone drill bit comprising:

a bit body having a first support arm, a second support arm, and a third support arm extending therefrom;

each support arm having a spindle extending therefrom;

a respective bearing structure associated with each spindle;

a respective cone assembly rotatably mounted on the bearing structure of each spindle for engagement with a subterranean formation to form a wellbore;

a respective cutting structure associated with each cone assembly;

each cone assembly having a respective axis of rotation corresponding generally with a longitudinal axis of each respective spindle;

each cone assembly having a minimal moment center located proximate each respective axis of rotation;

the minimal moment center of each respective cone assembly defined in part by each respective cutting structure; and each respective bearing structure having a center point located proximate the minimal moment center of the associated cone assembly.

2. The roller cone drill bit of claim 1 further comprising at least one respective bearing structure center point located proximate the minimal moment center of a respective cone assembly operable to minimize at least one anticipated end load acting on the at least one respective bearing structure.

3. The roller cone drill bit of claim 1 further comprising each cutting structure comprising a plurality of cutting elements.

4. The roller cone drill bit of claim 3 wherein the plurality of cutting elements further comprise a plurality of inserts.

5. The roller cone drill bit of claim 3 wherein the plurality of cutting elements further comprise a plurality of milled teeth.

6. The roller cone drill bit of claim 3 further comprising the plurality of cutting elements arranged in at least two rows.

7. The roller cone drill bit of claim 3 further comprising:

each cutting element having a crest extending from the associated cone assembly for engagement with a formation;

each crest having a respective crest point defined as a point located a greater distance from the axis of rotation of the associated cone assembly as compared with the distance between any other point on the crest and the axis of rotation of the associated cone assembly;

each cutting element having a normal force axis extending from the associated cone assembly through the respective crest point;

each cone assembly having a respective cone assembly profile defined in part as a combined projection of the crests of all cutting elements onto a vertical plane passing through the axis of rotation of the respective cone assembly; and the normal force axes of the cutting elements intersecting at a selected force center point.

8. The drill bit of claim 7 further comprising at least one row of cutting elements on each cone assembly having the respective crest points located at approximately the same radial distance from the rotational axis of the cone.

9. The drill bit of claim 7 further comprising at least two rows of cutting elements on each cone having respective crest points located at approximately the same radial distance from the rotational axis of the cone assembly.

10. The roller cone drill bit of claim 1 further comprising each bearing structure selected from the group consisting of a roller bearing, a journal bearing, and a solid bearing.

11. The roller cone drill bit of claim 1 further comprising:

each cone assembly cutting structure having a cone profile and a set of insert profile angles; and each respective cone assembly minimal moment center defined by the respective cone profile and respective set of insert profile angles.

12. A roller cone drill bit comprising:

a bit body having at least a first support arm, a second support arm, and a third support arm extending therefrom, each support arm having a spindle extending therefrom;

a respective bearing structure associated with each spindle;

a respective cone assembly rotatably mounted on each bearing structure for engagement with a subterranean formation to form a wellbore, each cone assembly having a distinct cone profile;

each cone assembly having a respective axis of rotation extending from the associated support arm, each axis of rotation corresponding with the longitudinal axis of each respective spindle, each cone assembly having a minimal moment center located along the respective axis of rotation and defined by bearing end loads associated with each distinct cone profile; and each respective bearing structure having a center point proximate the respective minimal moment center.

13. The roller cone drill bit of claim 12 wherein at least one respective bearing structure center point provided proximate the respective minimal moment center operable to minimize at least one anticipated end load acting on the at least one respective bearing structure.

14. The roller cone drill bit of claim 12 further comprising each cone assembly having a distinct minimal moment center.

15. The roller cone drill bit of claim 12 further comprising each bearing structure selected from the group consisting of a roller bearing, a journal bearing, and a solid bearing.

16. The roller cone drill bit of claim 12 further comprising:

each cone assembly cutting structure having a cone profile and a set of insert profile angles; and each respective cone assembly minimal moment center defined by each respective cone profile and respective set of insert profile angles.

* * * * *